US008265513B2

(12) United States Patent
Okabe

(10) Patent No.: US 8,265,513 B2
(45) Date of Patent: Sep. 11, 2012

(54) IMAGE FORMING APPARATUS

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/344,323

(22) Filed: Jan. 5, 2012

(65) Prior Publication Data

US 2012/0107021 A1 May 3, 2012

Related U.S. Application Data

(63) Continuation of application No. 11/780,083, filed on Jul. 19, 2007, now Pat. No. 8,116,652.

(30) Foreign Application Priority Data

Jul. 19, 2006 (JP) ..... 2006-197121

(51) Int. Cl.
*G03G 15/00* (2006.01)

(52) U.S. Cl. ..... 399/90; 399/107; 399/110; 399/111; 399/119

(58) Field of Classification Search ..... 399/90, 399/107, 110, 111, 119
See application file for complete search history.

(56) References Cited

U.S. PATENT DOCUMENTS

| | | | | |
|---|---|---|---|---|
| 5,521,693 | A | 5/1996 | Kojima et al. | |
| 6,898,391 | B2 | 5/2005 | Numagami et al. | |
| 6,944,415 | B2 | 9/2005 | Nomura | |
| 7,062,192 | B2 | 6/2006 | Oguma et al. | |
| 7,092,657 | B2 | 8/2006 | Nakashima et al. | |
| 7,636,531 | B2 | 12/2009 | Ishii | |
| 7,890,012 | B2 * | 2/2011 | Koishi et al. | 399/90 |
| 2005/0053391 | A1 * | 3/2005 | Ahn et al. | 399/90 |
| 2007/0071482 | A1 * | 3/2007 | Okabe | 399/90 |
| 2007/0154232 | A1 * | 7/2007 | Buchanan et al. | 399/90 |
| 2007/0160380 | A1 | 7/2007 | Imaizumi et al. | |
| 2007/0286632 | A1 | 12/2007 | Okabe | |
| 2008/0292355 | A1 * | 11/2008 | Sakurai et al. | 399/110 |

FOREIGN PATENT DOCUMENTS

| | | |
|---|---|---|
| JP | 02-251872 | 10/1990 |
| JP | 04-337758 | 11/1992 |
| JP | 05-019552 | 1/1993 |
| JP | 10-301465 | 11/1998 |
| JP | 11-249362 | 9/1999 |
| JP | 2000-181166 | 6/2000 |
| JP | 2002-244382 | 8/2002 |

* cited by examiner

*Primary Examiner* — David Gray
*Assistant Examiner* — Francis Gray
(74) *Attorney, Agent, or Firm* — Banner & Witcoff, Ltd.

(57) ABSTRACT

The present invention provides a configuration in which an electrically connected condition can further be stabilized in electrical-connection zones between a body of an image-forming apparatus, and an image-forming unit and a plurality of image-forming cartridges. Developing electrode members and wire power-feed electrodes are attached to a slide frame. Each of the developing electrode members has a first body-side contact. The developing electrode members are electrically connected with the developing-roller output terminals. The wire power-feed electrodes are electrically connected with wire output terminals through contact with the wire output terminals. The developing electrode members are elastically deformed as a result of their first body-side contacts being pressed in a direction, which is along a slide direction, by the developing-roller output terminals. The wire power-feed electrodes are pressed in a paper width direction by the wire output terminals.

13 Claims, 25 Drawing Sheets

IMAGE FORMING APPARATUS

CROSS REFERENCE TO RELATED APPLICATION

This application is a continuation of co-pending U.S. patent application Ser. No. 11/780,083, filed Jul. 19, 2007, which is based upon and claims the benefit of priority from Japanese Patent Application No. 2006-197121, filed in Japan on Jul. 19, 2006, and incorporates this basic application herein in its entirety.

BACKGROUND OF THE INVENTION

1. Technical Field

The present invention relates to an image-forming apparatus configured to be capable of forming a multicolor image. The present invention also relates to an image-forming-cartridge support member configured to be capable of being drawn out from the body of the image-forming apparatus and to be capable of supporting a plurality of image-forming cartridges. The present invention further relates to an image-forming unit which is accommodated in the image-forming apparatus.

2. Background Art

A known image-forming apparatus of this kind is configured such that an image-forming unit which removably accommodates a plurality of image-forming cartridges can be attached to/detached from the body of the image-forming apparatus as appropriate. An image-forming apparatus of this kind is disclosed in, for example, Japanese Patent Application Laid-Open (koka1) Nos. 4-337758, 2000-181166, and 2002-244382.

For example, the image-forming apparatus disclosed in Japanese Patent Application Laid-Open (koka1) No. 4-337758 has a main cartridge and a plurality of subcartridges. The main cartridge is configured to be attachable to/detachable from the body of the image-forming apparatus as appropriate. The main cartridge has an image-carrying body on which an electrostatic latent image is formed. The subcartridges are configured to be attachable to/detachable from the main cartridge. Each of the subcartridges serves as a developing device and has a developing-agent-carrying body (developing roller).

The image-forming apparatus is configured such that electrical connection between the subcartridges and the body of the image-forming apparatus is established via the main cartridge. Specifically, one end of the developing-agent-carrying body provided in each of the subcartridges touches a contact member which is fixed on a contact board provided in the main cartridge. Also, the contact boards touch respective contacts provided on the body of the image-forming apparatus. This establishes electrical connection between the developing-agent-carrying bodies and a high-voltage power unit provided in the body of the image-forming apparatus and adapted to generate developing bias, thereby applying a developing bias voltage between the image-carrying body and the developing-agent-carrying bodies.

DISCLOSURE OF THE INVENTION

In the image-forming apparatus having the above-mentioned configuration, in order to carry out a stable image-forming operation, an electrically connected condition must be stabilized in electrical-connection zones between the body of the image-forming apparatus, and the image-forming unit and the plurality of image-forming cartridges.

Meanwhile, in the image-forming apparatus, developing agents of colors differ in terms of consumption. Accordingly, there arises a need of carrying out such a maintenance work that, each time lack of a developing agent of a certain color arises, the image-forming unit is removed from the body of the image-forming apparatus, and an image-forming cartridge which lacks a developing agent is replaced. Such maintenance work may be carried out frequently with an image-forming apparatus of this kind.

When the above-mentioned maintenance work is carried out frequently, the electrical-connection zones may suffer damage, such as plastic deformation. When such damage arises on the body of the image-forming apparatus, which body is relatively longer in service life than the image-forming cartridges, an electrically connected condition in the electrical-connection zones may become less stable.

The present invention has been achieved for solving the above problems, and an object of the invention is to provide a configuration in which an electrically connected condition can further be stabilized in electrical-connection zones between the body of the image-forming apparatus, and the image-forming unit and the plurality of image-forming cartridges.

An image-forming apparatus of the present invention is configured to be capable of forming a multicolor image by use of particulate developing agents. Specifically, the image-forming apparatus comprises a body frame, a slide frame, a plurality of electrostatic-latent-image-carrying bodies, a plurality of chargers, a plurality of image-forming cartridges, a plurality of first electrode members, and a plurality of second electrode members.

The body frame is a member which serves as a body of the image-forming apparatus. The slide frame is supported by the body frame. The slide frame is configured to be capable of being drawn out from the body frame along a predetermined slide direction.

Each of the electrostatic-latent-image-carrying bodies is configured such that an electrostatic latent image can be formed on an electrostatic-latent-image-forming surface, which is a circumferential surface of the electrostatic-latent-image-carrying body. A plurality of the electrostatic-latent-image-carrying bodies is arranged along the slide direction.

Each of the chargers is configured to be capable of uniformly charging the electrostatic-latent-image-forming surface. A plurality of the chargers is arranged along the slide direction.

Each of the image-forming cartridges has a developing-agent-carrying body. The developing-agent-carrying body is configured to be capable of carrying a developing agent in a charged state. The developing-agent-carrying body is configured such that the charged developing agent is carried on a developing-agent-carrying surface, which is a circumferential surface of the developing-agent-carrying body and faces the electrostatic-latent-image-forming surface.

A plurality of the image-forming cartridges is arranged along the slide direction. Each of the image-forming cartridges is attached to the slide frame in such a manner as to be removable along a predetermined attachment/detachment direction intersecting with the slide direction.

Notably, each of the electrostatic-latent-image-carrying bodies can be attached to the slide frame or to the corresponding image-forming cartridge. Also, each of the chargers can be attached to the slide frame or to the corresponding image-forming cartridge.

Each of the first electrode members is attached to the slide frame. A plurality of the first electrode members are arranged along the slide direction. In order to electrically connect the body of the image-forming apparatus to the developing-agent-carrying bodies of the image-forming cartridges, the first electrode members are provided in corresponding relation with the image-forming cartridges.

Each of the second electrode members is attached to the slide frame. A plurality of the second electrode members are arranged along the slide direction. In order to electrically connect the body of the image-forming apparatus to the electrostatic-latent-image-bearing bodies and to the chargers, the second electrode members are provided in corresponding relation with the electrostatic-latent-image-bearing bodies and with the chargers.

The body frame has first body-frame contacts and second body-frame contacts. Each of the first body-frame contacts is configured to be capable of feeding power to the corresponding first electrode member. Each of the second body-frame contacts is configured to be capable of feeding power to the corresponding second electrode member.

Each of the first electrode members has a first body-side contact and a first cartridge-side contact. The first body-side contact is disposed in such a manner as to project toward the body frame. The first body-side contact is configured to be capable of being electrically connected with the first body-frame contact through contact with the first body-frame contact. The first cartridge-side contact is disposed in such a manner as to project toward the image-forming cartridge. The first cartridge-side contact is configured to be capable of being electrically connected with an image-forming-cartridge contact provided on the image-forming cartridge through contact with the image-forming-cartridge contact.

Each of the second electrode members has a second body-side contact. The second body-side contact is disposed in such a manner as to project toward the body frame. The second body-side contact is configured to be capable of being electrically connected with the second body-frame contact through contact with the second body-frame contact.

In the present invention, each of the first electrode members is configured such that, by means of the first body-side contact and the first body-frame contact being pressed against each other along the slide direction, electrical connection can be established between the first body-side contact and the first body-frame contact while the first body-side contact is elastically deformed. Also, each of the second electrode members is configured such that, by means of the second body-side contact being pressed in a direction intersecting with the slide direction, the second body-side contact and the second body-frame contact come into contact with each other.

Preferably, a direction along the slide direction and along which the first body-side contacts and the respective first body-frame contacts are pressed against each other and a direction along which the second body-side contacts are pressed are orthogonal to each other. For example, the direction along which the second body-side contacts are pressed can coincide with a width direction of the image-forming apparatus, which width direction is orthogonal to the slide direction.

Notably, a direction (pressing direction) along the slide direction and along which the first body-side contacts and the respective first body-frame contacts are pressed against each other does not necessarily coincide completely with the slide direction. For example, when a plane which is orthogonal to the width direction of the image-forming apparatus and includes the slide direction is assumed, the pressing direction is determined on the plane or so as to form a small angle with respect to the plane. Preferably, the angle between the pressing direction and the slide direction is less than 90 degrees.

The image-forming unit of the present invention is configured to be capable of being accommodated in the image-forming apparatus. Specifically, the image-forming unit comprises the body frame, the slide frame, a plurality of the electrostatic-latent-image-carrying bodies, a plurality of the chargers, a plurality of the image-forming cartridges, a plurality of the first electrode members, and a plurality of the second electrode members.

An image-forming-cartridge support member of the present invention is configured such that the image-forming cartridges can be supported while being arranged along the direction of arrangement. Specifically, the image-forming-cartridge support member comprises the slide frame, a plurality of the first electrode members, and a plurality of the second electrode members.

In the thus-configured image-forming apparatus, image-forming unit, and image-forming-cartridge support member of the present invention, the first body-side contacts attached to the slide frame and the respective first body-frame contacts attached to the body frame are pressed against each other. This establishes electrical connection between the first body-side contacts and the respective first body-frame contacts. At this time, the first body-side contacts provided on the slide frame are elastically deformed.

This configuration may involve occurrence of damage to the first body-side contact(s); for example, damage in which deformation of the first body-side contact exceeds the limit of elastic deformation and reaches plastic deformation. However, in the present invention, the first body-side contacts are provided on the slide frame, rather than on the body frame. This can effectively restrain occurrence of damage in electrical-connection zones on the side of the body frame, which involves greater difficulty in replacing members than does the slide frame.

The second body-side contacts attached to the slide frame and the respective second body-frame contacts attached to the body frame are in contact with each other. This establishes electrical connection between the second body-side contacts and the respective second body-frame contacts.

At this time, the second body-side contacts are pressed in a direction intersecting with the slide direction. That is, a pressing direction for establishing electrical connection between the first body-side contacts and the respective first body-frame contacts and a pressing direction for establishing electrical connection between the second body-side contacts and the respective second body-frame contacts intersect with each other.

Thus, a pressing condition for establishing electrical connection between the first body-side contacts and the respective first body-frame contacts and a pressing condition for establishing electrical connection between the second body-side contacts and the respective second body-frame contacts can be established substantially independently of each other. This can effectively restrain the occurrence of, for example, the following drawback: when the pressing condition of the former is weakened for a certain reason, this causes weakening of the pressing condition of the latter, thereby unpreparedly canceling the electrically connected condition of the latter.

Thus, according to the present invention, an electrically connected condition can further be stabilized in electrical-connection zones between the body frame of the image-forming apparatus, and the image-forming unit and the plurality of image-forming cartridges.

The slide frame may be configured to be attachable to/detachable from the body frame. This facilitates replacement of the slide frame even when the first body-side contact(s) is damaged, so that a good electrically connected condition can be readily restored.

Each of the first electrode members may be configured such that a direction along which the first cartridge-side contact and the image-forming-cartridge contact are pressed against each other and a direction along which the first body-side contact and the first body-frame contact are pressed against each other intersect with each other.

According to this configuration, when the image-forming cartridges are attached to the slide frame, the first cartridge-side contacts and the respective image-forming-cartridge contacts are pressed against each other, whereby electrical connection is established between the first cartridge-side contacts and the respective image-forming-cartridge contacts. Also, as mentioned above, when the slide frame is attached to the body frame, the first body-side contacts and the respective first body-frame contacts are pressed against each other, whereby electrical connection is established between the first body-side contacts and the respective first body-frame contacts.

At this time, a direction along which the first cartridge-side contacts and the respective image-forming-cartridge contacts are pressed against each other and a direction along which the first body-side contacts and the respective first body-frame contacts are pressed against each other intersect with each other. Thus, a pressing condition for establishing electrical connection between the first cartridge-side contacts and the respective image-forming-cartridge contacts and a pressing condition for establishing electrical connection between the first body-side contacts and the respective first body-frame contacts can be established substantially independently of each other.

Thus, an electrically connected condition can further be stabilized in electrical-connection zones between the body frame of the image-forming apparatus, and the image-forming unit and the plurality of image-forming cartridges.

Each of the image-forming cartridges, and the slide frame may be configured such that, by means of urging the image-forming cartridge in a predetermined positioning direction, which is along the direction along which the first cartridge-side contact and the image-forming-cartridge contact are pressed against each other, positioning between the image-forming cartridge and the slide frame is established.

According to this configuration, by means of each of the image-forming cartridges being urged in the positioning direction, positioning between the image-forming cartridge and the slide frame is established. At this time, the image-forming-cartridge contact provided on the image-forming cartridge and the first cartridge-side contact provided on the slide frame are pressed against each other in a direction along the positioning direction.

Notably, the positioning direction and the pressing direction may face the same direction or opposite directions. Particularly, in the former case, by means of the pressing direction and the positioning direction coinciding with each other, positioning is carried out more reliably.

The positioning direction may be a direction along which each of the image-forming cartridges receives force from the body frame when the image-forming cartridge carries out an image-forming operation.

According to this configuration, when each of the image-forming cartridges carries out an image-forming operation, the image-forming cartridge is urged in the positioning direction. This establishes positioning between the image-forming cartridge and the slide frame.

This configuration allows a simple apparatus configuration to yield the following: when each of the image-forming cartridges carries out an image-forming operation, force which the image-forming cartridge receives from the body frame stably establishes positioning between the image-forming cartridge and the slide frame and electrical connection between the image-forming-cartridge contact and the first cartridge-side contact.

The configuration may be such that the slide frame has guide portions for guiding the respective image-forming cartridges along the attachment/detachment direction and such that the first cartridge-side contacts are disposed in such a manner as to face the respective guide portions.

According to this configuration, when each of the image-forming cartridges is attached to the slide frame, the image-forming cartridge is guided along the attachment/detachment direction by the guide portion. Also, upon completion of attachment of the image-forming cartridge to the slide frame, the image-forming-cartridge contact provided on the image-forming cartridge comes into contact with the corresponding first cartridge-side contact, which is disposed in such a manner as to face the corresponding guide portion. This establishes electrical connection between the image-forming-cartridge contact and the corresponding first cartridge-side contact.

According to this configuration, while the image-forming cartridges are guided by the respective guide portions, electrical connection is established between the first cartridge-side contacts, which are disposed in such a manner as to face the respective guide portions, and the respective image-forming-cartridge contacts. Therefore, the reliability of this electrical connection is improved.

The configuration may be such that the slide frame has a pair of side plates disposed in parallel with the slide direction and with the attachment/detachment direction and such that the guide portion comprises a guide groove formed on the side plate.

According to this configuration, when each of the image-forming cartridges is attached to the slide frame, the image-forming cartridge is inserted into a space bounded by the paired side plates. At this time, the image-forming cartridge is guided along the attachment/detachment direction by the corresponding guide grooves.

According to this configuration, while the image-forming cartridges are guided by the respective guide grooves, electrical connection is established between the first cartridge-side contacts, which are disposed in such a manner as to face the respective guide grooves, and the respective image-forming-cartridge contacts. Therefore, the reliability of this electrical connection can be improved by means of a simple apparatus configuration.

The configuration may be such that each of the first electrode members has a wirelike connection portion for connecting the first body-side contact and the first cartridge-side contact and is attached to one of the side plates in the vicinity of the corresponding guide groove.

According to this configuration, each of the electrode members for establishing electrical connection between the body of the image-forming apparatus and the image-forming cartridges can be formed in a very simple structure. Since the electrode members are disposed in the vicinity of the respective guide grooves, electrical connection is more reliably established between the first cartridge-side contacts, which are disposed in such a manner as to face the respective guide grooves, and the respective image-forming-cartridge contacts.

The configuration may be such that an integral wirelike member having a torsional-coil-spring shape is used to form the connection portion and the first cartridge-side contact and such that an arm portion extending outward from a coil portion of the torsional-coil-spring shaped member is used to form the first cartridge-side contact.

According to this configuration, each of the image-forming-cartridge contacts urges the arm portion against elastic force of the torsional coil spring, whereby contact and electrical connection between the arm portion (the cartridge-side contact) and the image-forming-cartridge contact are established.

This configuration yields the following effect. According to this configuration, each of the electrode members for establishing electrical connection between the body of the image-forming apparatus and the image-forming cartridges can be formed in a very simple structure. Also, by virtue of elastic force of the torsional coil springs, contact and electrical connection between the first cartridge-side contacts and the respective image-forming-cartridge contacts are established reliably.

The configuration may be such that each of the image-forming-cartridge contacts assumes the form of an electrically conductive projection formed to be capable of being received in the corresponding guide groove and such that each of the first cartridge-side contacts is disposed to be capable of being electrically connected with the corresponding projection through contact with the projection.

According to this configuration, when each of the image-forming cartridges is attached to the slide frame, the projection is received in the corresponding guide groove, whereby the image-forming cartridge is guided by the guide groove. Also, through contact of the projection with the corresponding first cartridge-side contact, electrical connection is established between the projection and the first cartridge-side contact.

According to this configuration, by means of a very simple apparatus configuration, the image-forming cartridges can be smoothly attached to the slide frame. Also, by means of a very simple apparatus configuration, a reliable, electrically connected condition can be established between the image-forming-cartridge contacts and the respective first cartridge-side contacts.

Each of the developing-agent-carrying bodies can assume the form of a developing roller which has a metal shaft projecting from its longitudinal end portions and can rotate through rotation of the shaft. In this case, each of the projections can assume the form of a collar member made of an electrically conductive, synthetic resin and configured to cover the metal shaft of the corresponding developing roller (the developing-agent-carrying body).

According to this configuration, when each of the image-forming cartridges is attached to the slide frame, the collar member is received in the guide groove, whereby the image-forming cartridge is guided by the guide groove. Also, through contact of the collar member with the first cartridge-side contact, electrical connection is established between the first cartridge-side contact, and the collar member and the developing roller (the developing-agent-carrying body).

According to this configuration, by means of a very simple apparatus configuration, a reliable, electrically connected condition can be established between the developing rollers (the developing-agent-carrying bodies) and the respective first cartridge-side contacts.

The configuration may be such that each of the paired side plates assumes the form of a plurality of side plates respective to the image-forming cartridges and arranged along the slide direction; such that a support plate is disposed externally of and supports the plurality of side plates in the slide frame; and such that the first body-side contacts are disposed in such a manner as to extend through the support plate and to be exposed to the outside of the support plate.

According to this configuration, a configuration for supporting the image-forming cartridges arranged along the slide direction and a configuration for establishing electrical communication between the developing-agent-carrying bodies and the body of the image-forming apparatus can be formed inexpensively by a very simple manufacturing process.

The configuration may be such that each of the image-forming cartridges is configured such that drive force is transmitted from the body frame to the image-forming cartridge at one end portion, with respect to a width direction orthogonal to the slide direction and to the attachment/detachment direction, of the image-forming cartridge and such that each of the first and second electrode members is disposed in such a manner as to face the other end portion, different from the one end portion, of the image-forming cartridge.

According to this configuration, drive force is transmitted from the body frame to each of the image-forming cartridges at the one end portion with respect to the width direction of the image-forming cartridge. By contrast, electrical connection between the body of the image-forming apparatus and each of the image-forming cartridges is established via the electrode member at the other end portion with respect to the width direction of the image-forming cartridge.

According to this configuration, even when foreign matter, such as dust or oil stain, arises in a zone of transmission of the drive force, there can be reliably prevented adhesion of the foreign matter to a zone of electrical connection between the first electrode member and the image-forming-cartridge contact and to a zone of electrical connection between the first electrode member and the first body-frame contact. Therefore, a reliable, electrically connected condition can be established in the electrical-connection zones.

Each of the electrostatic-latent-image-carrying bodies can assume the form of a photoconductor drum which is rotatably supported by the slide frame and is a cylindrical member disposed along the width direction orthogonal to the slide direction and to the attachment/detachment direction. Each of the developing-agent-carrying bodies can assume the form of a developing roller which has a metal shaft projecting from its longitudinal end portions and can rotate through rotation of the shaft. In this case, each of the image-forming cartridges can be disposed such that, when the image-forming cartridge is attached to the slide frame, the image-forming cartridge is disposed to face the photoconductor drum, so as to be capable of developing the electrostatic latent image formed on the electrostatic-latent-image-forming surface.

In this configuration, each of the image-forming cartridges is inserted into the slide frame along the attachment/detachment direction, thereby being attached to the slide frame. At this time, the first cartridge-side contact and the image-forming-cartridge contact come into contact with each other. This establishes electrical connection between the first cartridge-side contact and the image-forming-cartridge contact. The image-forming cartridge is disposed to face the electrostatic-latent-image-carrying body, so as to be capable of developing the electrostatic latent image formed on the circumferential surface of the electrostatic-latent-image-carrying body.

The configuration may be such that the number of the first electrode members corresponds to the number of the image-forming cartridges.

According to this configuration, each of the first electrode members for establishing electrical connection between the body of the image-forming apparatus and a plurality of the image-forming cartridges can be formed in a very simple structure.

An image-forming apparatus of the present invention is configured to be capable of forming a multicolor image by use of particulate developing agents. Specifically, the image-forming apparatus comprises a body frame, a slide frame, a plurality of electrostatic-latent-image-carrying bodies, a plurality of chargers, a plurality of image-forming cartridges, and a plurality of electrode members.

The body frame is a member which serves as a body of the image-forming apparatus. The slide frame is supported by the body frame. The slide frame is configured to be capable of being drawn out from the body frame along a predetermined slide direction.

Each of the image-forming cartridges is attached to the attachment/detachment direction intersecting with the slide direction. A plurality of the image-forming cartridges is arranged along the slide direction.

Each of the electrode members is attached to the slide frame. A plurality of the electrode members are arranged along the slide direction. In order to electrically connect the body of the image-forming apparatus to the image-forming cartridges, the electrode members are provided in corresponding relation with the image-forming cartridges.

The body frame has body-frame contacts each being configured to be capable of feeding power to the electrode member in the slide frame.

Each of the electrode members has a body-side contact and a cartridge-side contact. The body-side contact is disposed in such a manner as to project toward the body frame. The body-side contact is configured to be capable of being electrically connected with the body-frame contact through contact with the body-frame contact. The cartridge-side contact is disposed in such a manner as to project toward the image-forming cartridge. The cartridge-side contact is configured to be capable of being electrically connected with an image-forming-cartridge contact provided on the image-forming cartridge through contact with the image-forming-cartridge contact.

In the present invention, each of the electrode members is configured such that, by means of the body-side contact and the body-frame contact being pressed against each other along the slide direction, electrical connection can be established between the body-side contact and the body-frame contact while the body-side contact is elastically deformed.

Notably, a direction (pressing direction} along the slide direction and along which the body-side contacts and the respective body-frame contacts are pressed against each other does not necessarily coincide completely with the slide direction. For example, when a plane which is orthogonal to the width direction of the image-forming apparatus and includes the slide direction is assumed, the pressing direction is determined on the plane or so as to form a small angle with respect to the plane. Preferably, the angle between the pressing direction and the slide direction is less than 90 degrees.

The image-forming unit of the present invention is configured to be capable of being accommodated in the image-forming apparatus. Specifically, the image-forming unit comprises the body frame, the slide frame, a plurality of the image-forming cartridges, and a plurality of the electrode members.

An image-forming-cartridge support member of the present invention is configured such that the image-forming cartridges can be supported while being arranged along the direction of arrangement. Specifically, the image-forming-cartridge support member comprises the slide frame and a plurality of the electrode members.

In the thus-configured image-forming apparatus, image-forming unit, and image-forming-cartridge support member of the present invention, the body-side contacts attached to the slide frame and the respective body-frame contacts attached to the body frame are pressed against each other. This establishes electrical connection between the body-side contacts and the respective body-frame contacts. At this time, the body-side contacts provided on the slide frame are elastically deformed.

This configuration may involve occurrence of damage to the body-side contact(s); for example, damage in which deformation of the body-side contact exceeds the limit of elastic deformation and reaches plastic deformation. However, in the present invention, the body-side contacts are provided on the slide frame, rather than on the body frame. This can effectively restrain occurrence of damage in electrical-connection zones on the side of the body frame, which involves greater difficulty in replacing members than does the slide frame.

Thus, according to the present invention, an electrically connected condition can further be stabilized in electrical-connection zones between the body frame of the image-forming apparatus, and the image-forming unit and the plurality of image-forming cartridges.

The slide frame may be configured to be attachable to/detachable from the body frame. This facilitates replacement of the slide frame; thus, even when the body-side contact(s) is damaged, a good electrically connected condition can be readily restored.

Each of the electrode members may be configured such that a direction along which the cartridge-side contact and the image-forming-cartridge contact are pressed against each other and a direction along which the body-side contact and the body-frame contact are pressed against each other intersect with each other.

According to this configuration, when the image-forming cartridges are attached to the slide frame, the cartridge-side contacts and the respective image-forming-cartridge contacts are pressed against each other, whereby electrical connection is established between the cartridge-side contacts and the respective image-forming-cartridge contacts. Also, as mentioned above, when the slide frame is attached to the body frame, the body-side contacts and the respective body-frame contacts are pressed against each other, whereby electrical connection is established between the body-side contacts and the respective body-frame contacts.

At this time, a direction along which the cartridge-side contacts and the respective image-forming-cartridge contacts are pressed against each other and a direction along which the body-side contacts and the respective body-frame contacts are pressed against each other intersect with each other. Thus, a pressing condition for establishing electrical connection between the cartridge-side contacts and the respective image-forming-cartridge contacts and a pressing condition for establishing electrical connection between the body-side contacts and the respective body-frame contacts can be established substantially independently of each other.

Thus, an electrically connected condition can further be stabilized in electrical-connection zones between the body frame of the image-forming apparatus, and the image-forming unit and the plurality of image-forming cartridges.

Each of the image-forming cartridges, and the slide frame may be configured such that, by means of urging the image-forming cartridge in a predetermined positioning direction, which is along the direction along which the cartridge-side contact and the image-forming-cartridge contact are pressed against each other, positioning between the image-forming cartridge and the slide frame is established.

According to this configuration, by means of each of the image-forming cartridges being urged in the positioning direction, positioning between the image-forming cartridge and the slide frame is established. At this time, the image-forming-cartridge contact provided on the image-forming cartridge and the cartridge-side contact provided on the slide frame are pressed against each other in a direction along the positioning direction.

Notably, the positioning direction and the pressing direction may face the same direction or opposite directions. Particularly, in the former case, by means of the pressing direction and the positioning direction coinciding with each other, positioning is carried out more reliably.

The positioning direction may be a direction along which each of the image-forming cartridges receives force from the body frame when the image-forming cartridge carries out an image-forming operation.

According to this configuration, when each of the image-forming cartridges carries out an image-forming operation, the image-forming cartridge is urged in the positioning direction. This establishes positioning between the image-forming cartridge and the slide frame. At this time, the image-forming-cartridge contact provided on the image-forming cartridge and the cartridge-side contact provided on the slide frame are pressed against each other in a direction along the positioning direction.

This configuration allows a simple apparatus configuration to yield the following: when each of the image-forming cartridges carries out an image-forming operation, force which the image-forming cartridge receives from the body frame stably establishes positioning between the image-forming cartridge and the slide frame and electrical connection between the image-forming-cartridge contact and the cartridge-side contact.

The configuration may be such that the slide frame has guide portions for guiding the respective image-forming cartridges along the attachment/detachment direction and such that the cartridge-side contacts are disposed in such a manner as to face the respective guide portions.

According to this configuration, when each of the image-forming cartridges is attached to the slide frame, the image-forming cartridge is guided along the attachment/detachment direction by the guide portion. Also, upon completion of attachment of the image-forming cartridge to the slide frame, the image-forming-cartridge contact provided on the image-forming cartridge comes into contact with the cartridge-side contact, which is disposed in such a manner as to face the guide portion. This establishes electrical connection between the image-forming-cartridge contact and the first cartridge-side contact.

According to this configuration, while the image-forming cartridges are guided by the respective guide portions, electrical connection is established between the cartridge-side contacts, which are disposed in such a manner as to face the respective guide portions, and the respective image-forming-cartridge contacts. Therefore, the reliability of this electrical connection is improved.

The configuration may be such that the slide frame has a pair of side plates disposed in parallel with the slide direction and with the attachment/detachment direction and such that the guide portion comprises a guide groove formed on the side plate.

According to this configuration, when each of the image-forming cartridges is attached to the slide frame, the image-forming cartridge is inserted into a space bounded by the paired side plates. At this time, the image-forming cartridge is guided along the attachment/detachment direction by the corresponding guide grooves.

According to this configuration, while the image-forming cartridges are guided by the guide grooves, electrical connection is established between the cartridge-side contacts, which are disposed in such a manner as to face the respective guide grooves, and the respective image-forming-cartridge contacts. Therefore, the reliability of this electrical connection can be improved by means of a simple apparatus configuration.

The configuration may be such that each of the electrode members has a wirelike connection portion for connecting the body-side contact and the cartridge-side contact and is attached to one of the side plates in the vicinity of the corresponding guide groove.

According to this configuration, each of the electrode members for establishing electrical connection between the body of the image-forming apparatus and the image-forming cartridges can be formed in a very simple structure. Since the electrode members are disposed in the vicinity of the respective guide grooves, electrical connection is more reliably established between the cartridge-side contacts, which are disposed in such a manner as to face the respective guide grooves, and the respective image-forming-cartridge contacts.

The configuration may be such that an integral wirelike member having a torsional-coil-spring shape is used to form the connection portion and the cartridge-side contact and such that an arm portion extending outward from a coil portion of the torsional-coil-spring shaped member is used to form the cartridge-side contact.

According to this configuration, each of the image-forming-cartridge contacts urges the arm portion against elastic force of the torsional coil spring, whereby contact and electrical connection between the arm portion (the cartridge-side contact) and the image-forming-cartridge contact are established.

This configuration yields the following effect. According to this configuration, each of the electrode members for establishing electrical connection between the body of the image-forming apparatus and the image-forming cartridges can be formed in a very simple structure. Also, by virtue of elastic force of the torsional coil springs, contact and electrical connection between the cartridge-side contacts and the respective image-forming-cartridge contacts are established reliably.

The configuration may be such that each of the image-forming-cartridge contacts assumes the form of an electrically conductive projection formed to be capable of being received in the guide groove and such that each of the cartridge-side contacts is disposed to be capable of being electrically connected with the corresponding projection through contact with the projection.

According to this configuration, when each of the image-forming cartridges is attached to the slide frame, the projection is received in the guide groove, whereby the image-forming cartridge is guided by the guide groove. Also, through contact of the projection with the cartridge-side contact, electrical connection is established between the projection and the cartridge-side contact.

According to this configuration, by means of a very simple apparatus configuration, the image-forming cartridges can be smoothly attached to the slide frame. Also, by means of a very simple apparatus configuration, a reliable, electrically connected condition can be established between the image-forming-cartridge contacts and the respective cartridge-side contacts.

Each of the image-forming cartridges may have a developing-agent-carrying body disposed in such a manner as to face an electrostatic-latent-image-carrying body on which an electrostatic latent image is formed. The developing-agent-carrying body is configured to be capable of carrying a charged particulate developing agent on its developing-agent-carrying surface, which faces the electrostatic-latent-image-forming surface. The developing-agent-carrying body can assume the form of a developing roller which has a metal shaft projecting from its longitudinal end portions and can rotate through rotation of the shaft. In this case, each of the projections can assume the form of a collar member made of an electrically conductive, synthetic resin and configured to cover the corresponding metal shaft.

According to this configuration, when each of the image-forming cartridges is attached to the slide frame, the collar member is received in the guide groove, whereby the image-forming cartridge is guided by the guide groove. Also, through contact of the collar member with the cartridge-side contact, electrical connection is established between the cartridge-side contact, and the collar member and the developing roller (the developing-agent-carrying body).

According to this configuration, by means of a very simple apparatus configuration, a reliable, electrically connected condition can be established between the developing rollers (the developing-agent-carrying bodies) and the respective cartridge-side contacts.

The configuration may be such that each of the paired side plates assumes the form of a plurality of side plates corresponding to the image-forming cartridges and arranged along the slide direction; such that a support plate is disposed externally of and supports the plurality of side plates in the slide frame; and such that the body-side contacts are disposed in such a manner as to extend through the support plate and to be exposed to the outside of the support plate.

According to this configuration, a configuration for supporting the image-forming cartridges arranged along the slide direction and a configuration for establishing electrical communication between the slide frame and the body of the image-forming apparatus can be formed inexpensively by a very simple manufacturing process.

The configuration may be such that each of the image-forming cartridges is configured such that drive force is transmitted from the body frame to the image-forming cartridge at one end portion, with respect to a width direction orthogonal to the slide direction and to the attachment/detachment direction, of the image-forming cartridge and such that each of the electrode members is disposed in such a manner as to face the other end portion, different from the one end portion, of the corresponding image-forming cartridge.

According to this configuration, drive force is transmitted from the body frame to each of the image-forming cartridges at the one end portion with respect to the width direction of the image-forming cartridge. By contrast, electrical connection between the body of the image-forming apparatus and each of the image-forming cartridges is established via the electrode member at the other end portion with respect to the width direction of the image-forming cartridge.

According to this configuration, even when foreign matter, such as dust or oil stain, arises in a zone of transmission of the drive force, there can be reliably prevented adhesion of the foreign matter to a zone of electrical connection between the electrode member and the image-forming-cartridge contact and to a zone of electrical connection between the electrode member and the first body-frame contact. Therefore, a reliable, electrically connected condition can be established in the electrical-connection zones.

In the above-mentioned configurations, a plurality of the electrostatic-latent-image-carrying bodies can be arranged along the slide direction in corresponding relation with the image-forming cartridges. Each of the electrostatic-latent-image-carrying bodies is configured such that an electrostatic latent image can be formed on its circumferential surface. Each of the electrostatic-latent-image-carrying bodies can assume the form of a photoconductor drum which is rotatably supported by the slide frame and is a cylindrical member disposed along the width direction orthogonal to the slide direction and to the attachment/detachment direction. In this case, each of the image-forming cartridges can be disposed such that, when the image-forming cartridge is attached to the slide frame, the image-forming cartridge is disposed to face the photoconductor drum, so as to be capable of developing the electrostatic latent image formed on the electrostatic-latent-image-forming surface.

In this configuration, each of the image-forming cartridges is inserted into the slide frame along the attachment/detachment direction, thereby being attached to the slide frame. At this time, the cartridge-side contact and the image-forming-cartridge contact come into contact with each other. This establishes electrical connection between the cartridge-side contact and the image-forming-cartridge contact. The image-forming cartridge is disposed to face the electrostatic-latent-image-carrying body, so as to be capable of developing the electrostatic latent image formed on the circumferential surface of the electrostatic-latent-image-carrying body.

The configuration may be such that the number of the electrode members corresponds to the number of the image-forming cartridges.

According to this configuration, each of the electrode members for establishing electrical connection between the body of the image-forming apparatus and a plurality of the image-forming cartridges can be formed in a very simple structure.

BRIEF DESCRIPTION OF THE DRAWINGS

FIG. 24 is a pair of side views showing an exemplary structure for urging downward the image-forming cartridge shown in FIG. 5, wherein

FIG. 25 is a pair of side sectional view showing, on an enlarged scale, a pressing-operation mechanism shown in FIG. 24, wherein

BEST MODE FOR CARRYING OUT THE INVENTION

An embodiment (the best mode contemplated by the applicant at the time of filing the present application) of the present invention will next be described with reference to the drawings.

Figure 1:
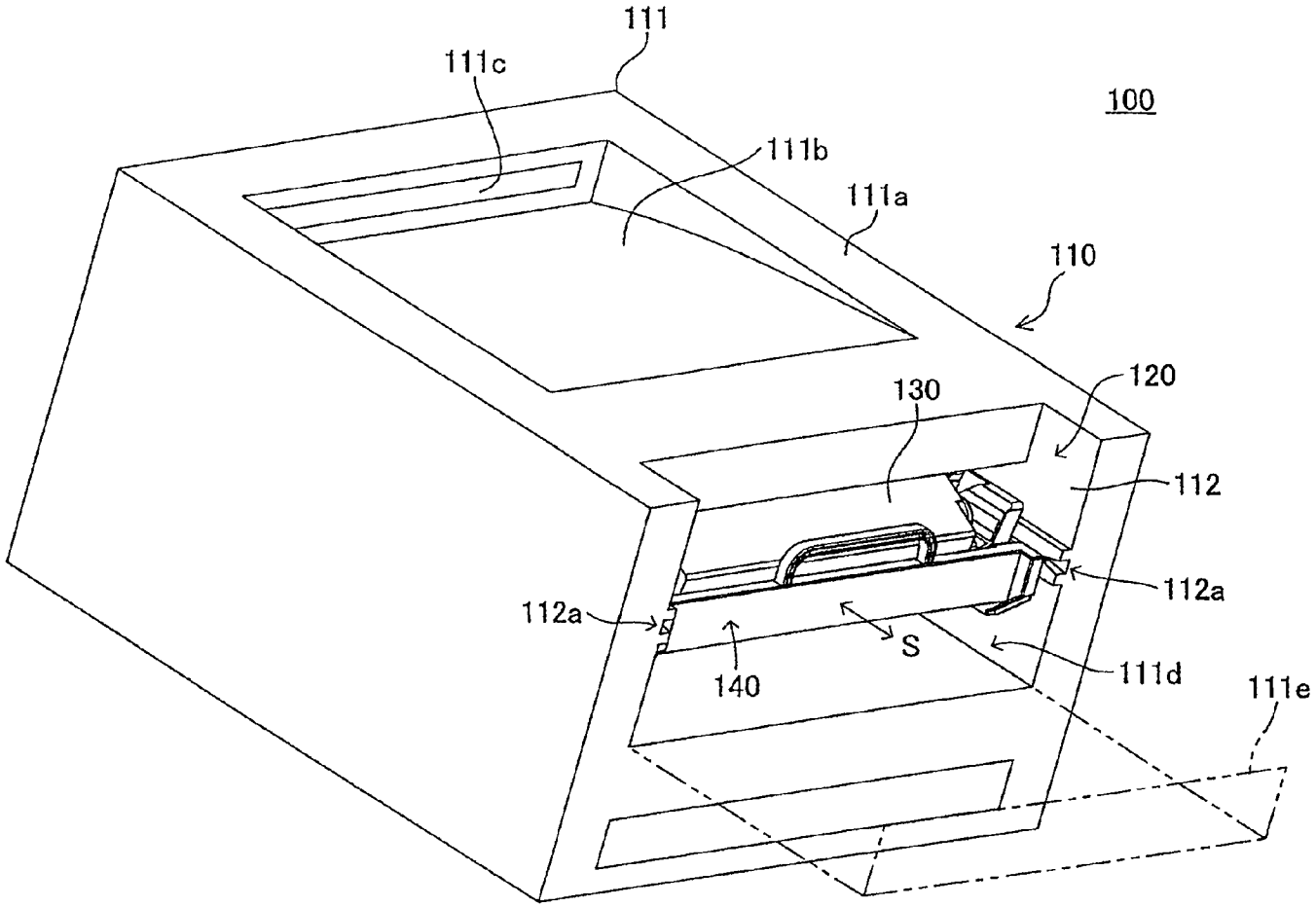
FIG. 1 is a perspective view showing the external appearance of a color laser printer according to an embodiment of an image-forming apparatus of the present invention.

Outline of overall configuration of color laser printer FIG. 1 is a perspective view showing the external appearance of a color laser printer 100 according to an embodiment of an image-forming apparatus of the present invention.

A body section 110, which serves as the body of the color laser printer 100, includes a body casing 111 and a body frame 112.

The body casing 111 is a member having a shape resembling a rectangular parallelepiped and is formed from a synthetic resin plate. An upper surface 111*a* of the body casing 111 has a catch tray 111*b*. The catch tray 111*b* includes a slope extending obliquely downward from the front side (near side) toward the rear side (far side) of the upper surface 111*a*. That is, the catch tray 111*b* assumes the form of a recess formed on the upper surface 111*a*.

A paper ejection port 111*c* in the form of an opening portion is formed at an upper portion of the body casing 111 and above a lower end portion of the catch tray 111*b*. That is, the catch tray 111*b* is configured to be capable of receiving paper ejected from the paper ejection port 111*c*.

A front opening portion 111*d* is formed at the front of the body casing 111. A plate-like front cover 111*e* is attached to the front of the body casing 111 in such a manner as to cover the front opening portion 111*d*. The front cover 111*e* is supported such that it can rotate about its lower end portion The body frame 112 is accommodated within the body casing 111. The body frame 112 is configured to be capable of supporting various members, which will be described later, associated with an image-forming operation. The body frame 112 has a drive source and a drive-force transmission mechanism for driving these various members, a power unit, and the like.

The body frame 112 has a pair of guide portions 112*a* provided at respective internal, opposite end portions, with respect to a paper width direction, of the body frame 112. The guide portions 112*a* are configured to be capable of being engaged with respective opposite end portions, with respect to the paper width direction, of a color-image-forming unit 120, which serves as the image-forming unit of the present invention. The guide portions 112*a* are configured to be capable of supporting the color-image-forming unit 120 within an internal space of the body frame 112.

The color-image-forming unit 120 is accommodated within the body frame 112 and is configured to be attachable to/detachable from the body frame 112.

Figure 2:
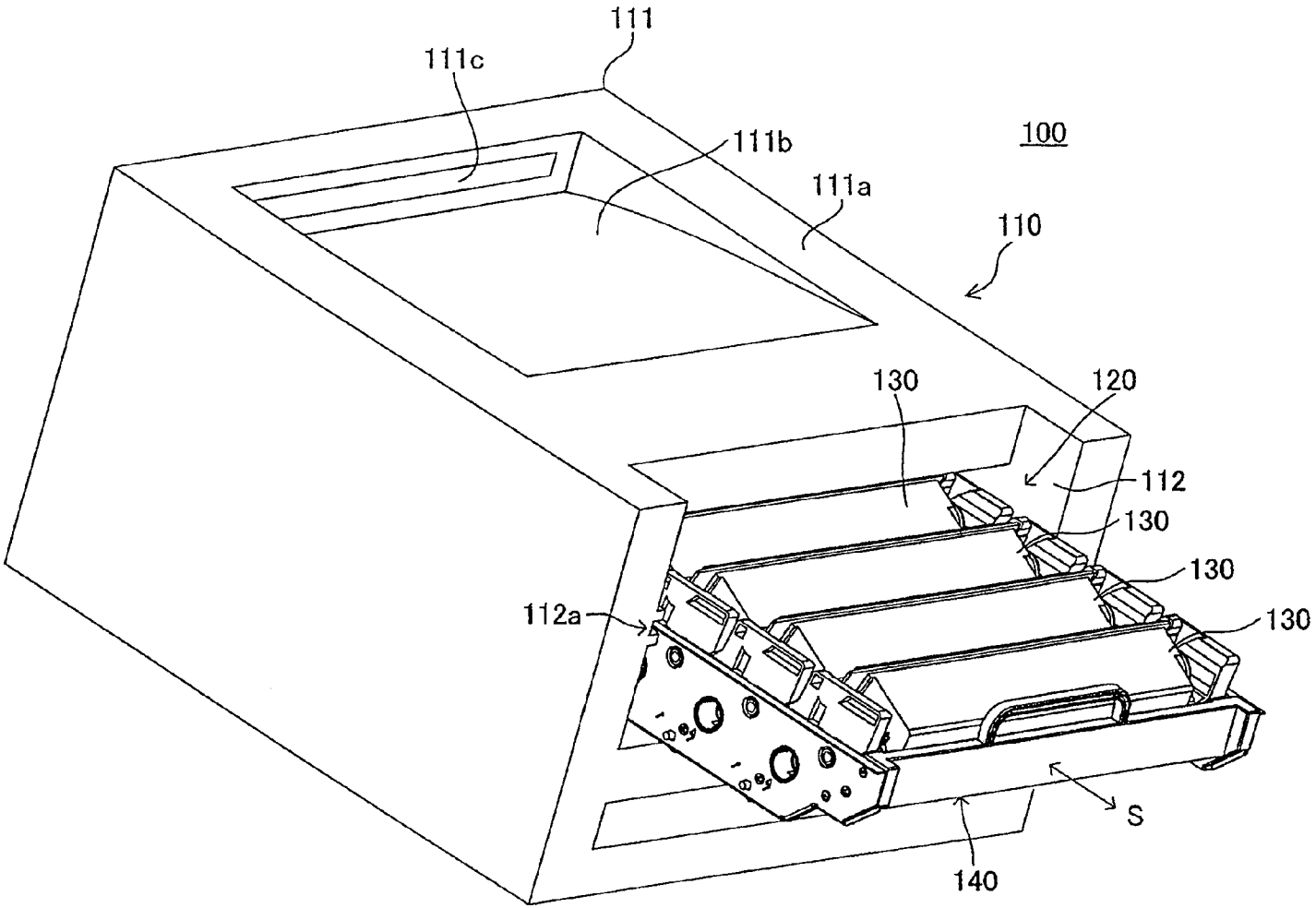
FIG. 2 is a perspective view showing a state in which a color-image-forming unit shown in FIG. 1 is drawn out frontward.
Figure 3:
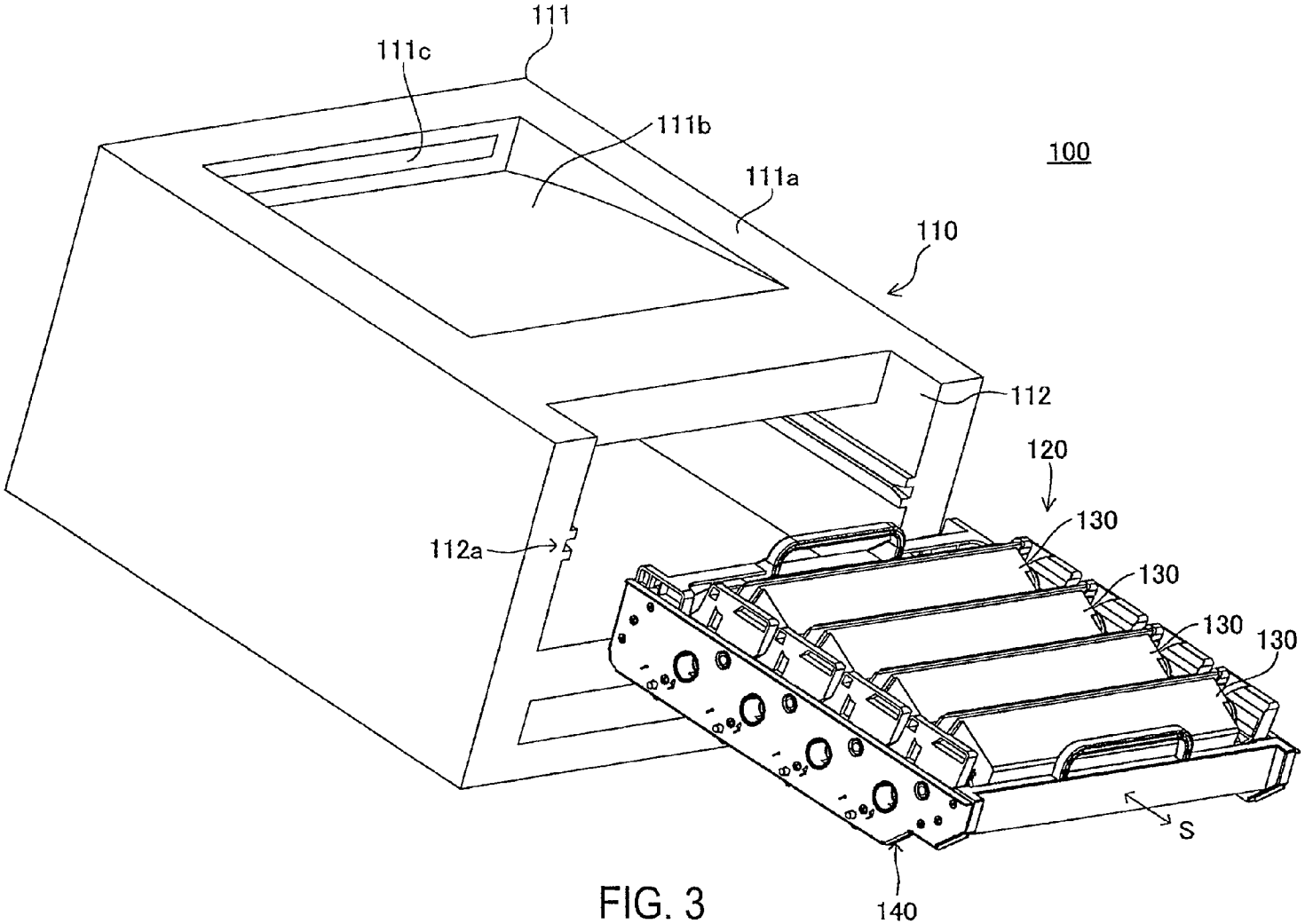
FIG. 3 is a perspective view showing a state in which the color-image-forming unit shown in FIG. 1 is drawn out further frontward.

FIG. 2 is a perspective view showing a state in which the color-image-forming unit 120 shown in FIG. 1 is drawn out frontward. FIG. 3 is a perspective view showing a state in which the color-image-forming unit 120 is drawn out further frontward, and shows a state in which the color-image-forming unit 120 is drawn out to the exterior of the body section 110.

As shown in FIGS. 2 and 3, the guide portions 112*a* are configured such that the color-image-forming unit 120 can be attached to/detached from the body frame 112 while being sliding in a direction indicated by arrow S (hereinafter, referred to as the "slide direction S") in the drawings. That is, the color laser printer 100 is configured such that the color-image-forming unit 120 can be detached from the body frame 112 as shown in FIGS. 2 and 3 by the steps of opening the front cover 111*e* frontward as shown in FIG. 1 and drawing out the color-image-forming unit 120 frontward along the slide direction S. Also, the color laser printer 100 is configured such that the color-image-forming unit 120 can be attached to the body frame 112 by the steps of opening the front cover 111*e* frontward as shown in FIG. 1 and pushing in the color-image-forming unit 120 backward along the slide direction S.

The color-image-forming unit 120 has image-forming cartridges 130 and the slide frame 140.

Referring to FIGS. 2 and 3, the slide frame 140, which serves as the image-forming-cartridge support member of the present invention, is supported by the guide portions 112*a* so as to be capable of being drawn out from the body frame 112 along the slide direction S. The slide frame 140 is configured to be capable of supporting a plurality of (four) image-forming cartridges 130 arranged along the slide direction S (in a direction parallel with the slide direction S).

The configuration of the image-forming cartridge 130 and that of the slide frame 140 will next be described in detail.

Internal Configuration of Image-Forming Cartridge

Figure 4:
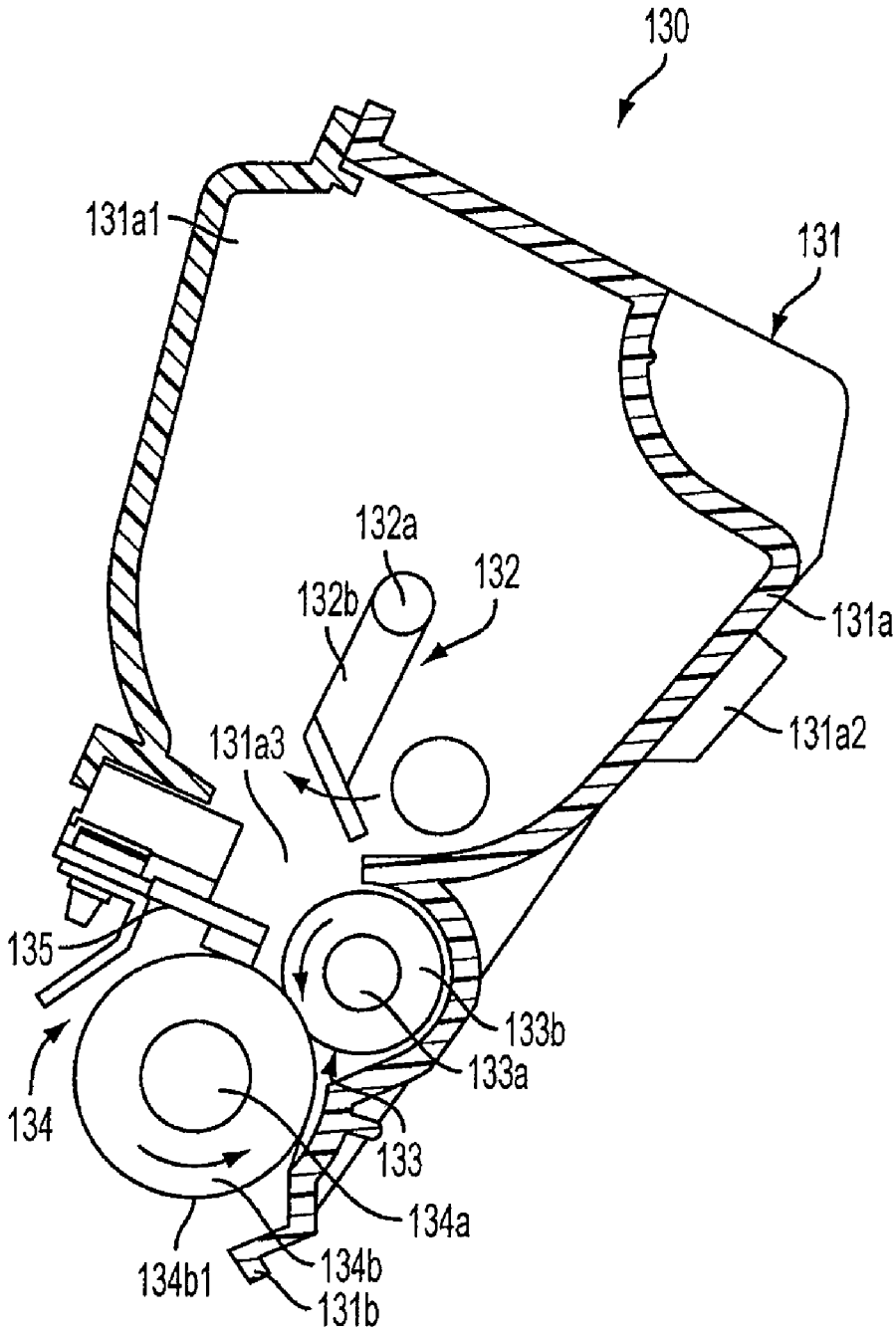
FIG. 4 is a side sectional view of an image-forming cartridge shown in FIG. 3.

FIG. 4 is a side sectional view of the image-forming cartridge 130 shown in FIG. 3.

Referring to FIG. 4, a cartridge case 131 is a member which serves as a casing of the image-forming cartridge 130, and is formed mainly from a plate material made of a synthetic resin, or the like.

A toner-containing case portion 131*a*, which is an upper portion of the cartridge case 131, is a box-like member made of a synthetic resin. A toner-containing chamber 131*a*, which is an internal space of the toner-containing case portion 131*a*1, contains toner, which serves as a developing agent of the present invention.

The toner-containing case portion 131*a* has a foot portion 131*a*2, which projects externally from a front surface in FIG. 1 (bottom surface: right-hand surface in FIG. 4). The foot portion 131*a*2 is configured such that when the image-forming cartridge 130 is placed on a workbench, a table, or the like, the foot portion 131*a*2 touches the upper surface of the workbench or the like, whereby the image-forming cartridge 130 can stably rest on the workbench or the like.

A bottom portion in FIG. 4 of the toner-containing case portion 131*a* has a toner passage opening 131*a*3, which is an opening portion for allowing passage of toner. The toner-containing case portion 131*a* has a support portion 131*b* at its bottom in FIG. 4 at a position corresponding to the toner passage opening 131*a*3. The support portion 131*b* is configured to be capable of supporting various members, which will be described later, for forming a thin layer of charged toner.

The toner-containing case portion 131*a* accommodates an agitator 132. The agitator 132 is supported rotatably by the toner-containing case portion 131*a*. The agitator 132 includes an agitator-rotating shaft 132*a* made of a metal, and an agitating member 132*b* fixedly attached to the agitator-rotating shaft 132*a*. The agitator 132 is configured such that, by means of being rotatably driven in the direction in FIG. 4, the agitator 132 agitates toner contained in the toner-containing chamber 131*a*1 and feeds the toner toward the toner passage opening 131*a*3.

A feed roller 133 is disposed in parallel with the paper width direction in the vicinity of the toner passage opening 131*a*3. The feed roller 133 includes a sponge roller and is rotatably supported by the support portion 131*b*. Specifically, the feed roller 133 includes a feed-roller-rotating shaft 133*a* and a sponge layer 133*b*. The feed-roller-rotating shaft 133*a* is a rodlike member made of a metal and is rotatably supported by the support portion 131*b*. The sponge layer 133*b* is formed from foam polyurethane and is formed on the circumference of the feed-roller-rotating shaft 133*a*.

A developing roller 134, which serves as the developing-agent-carrying body of the present invention, is disposed adjacent to the feed roller 133. The developing roller 134 includes a rubber roller and is rotatably supported by the support portion 131*b*. Specifically, the developing roller 134 includes a developing-roller-rotating shaft 134*a* made of a metal and a semiconductive rubber layer 134*b* formed on the circumference of the developing-roller-rotating shaft 134*a*. The semiconductive rubber layer 134*b* is formed from a synthetic resin mixed with carbon black.

The feed roller 133 and the developing-roller 134 are disposed such that the sponge layer 133*b* of the feed roller 133 and the semiconductive rubber layer 134*b* of the developing roller 134 are pressed against each other at a predetermined pressure, whereby the sponge layer 133*b* is elastically deformed.

The feed roller 133 is configured to be capable of feeding toner which has been fed through the toner passage opening 131*a*3, toward a position of contact between the feed roller 133 and the developing roller 134 by means of being rotatably driven in the direction of FIG. 4.

The feed roller 133 and the developing roller 134 are configured such that, by means of the developing roller 134 and the feed roller 133 being rotatably driven in the respective directions indicated by the arrows in FIG. 4, toner is frictionally charged at the position of contact between the feed roller 133 and the developing roller 134, whereby the charged toner can be carried on a toner-carrying surface 134*b*1 (developing-agent-carrying surface}, which is a circumferential surface of the semiconductive rubber layer 134*b*.

A toner-layer-thickness-regulating blade 135 is fixed to the support portion 131*b*. The toner-layer-thickness-regulating blade 135 is configured to be capable of regulating the amount of toner and the amount of static charges of toner on the toner-carrying surface 134*b*1 by means of touching, in the counter direction, the toner-carrying surface 134*b*1, which is a circumferential surface of the developing roller 134 rotatably driven in the direction indicated by the arrow in FIG. 4.

Configuration of External Portion of Image-Forming Cartridge

Figure 5:
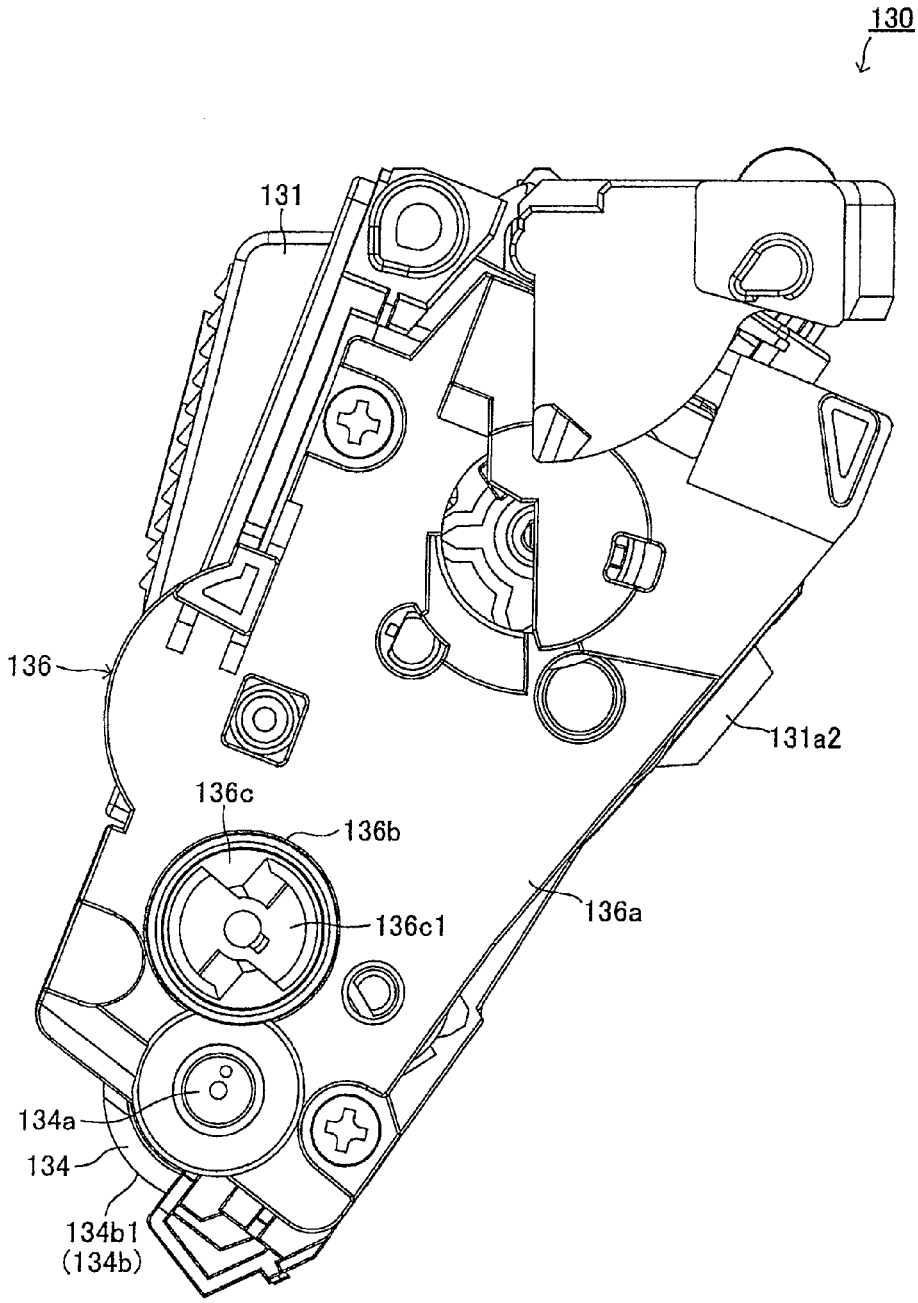
FIG. 5 is a side view showing the external appearance of the image-forming cartridge shown in FIG. 3.
Figure 6:
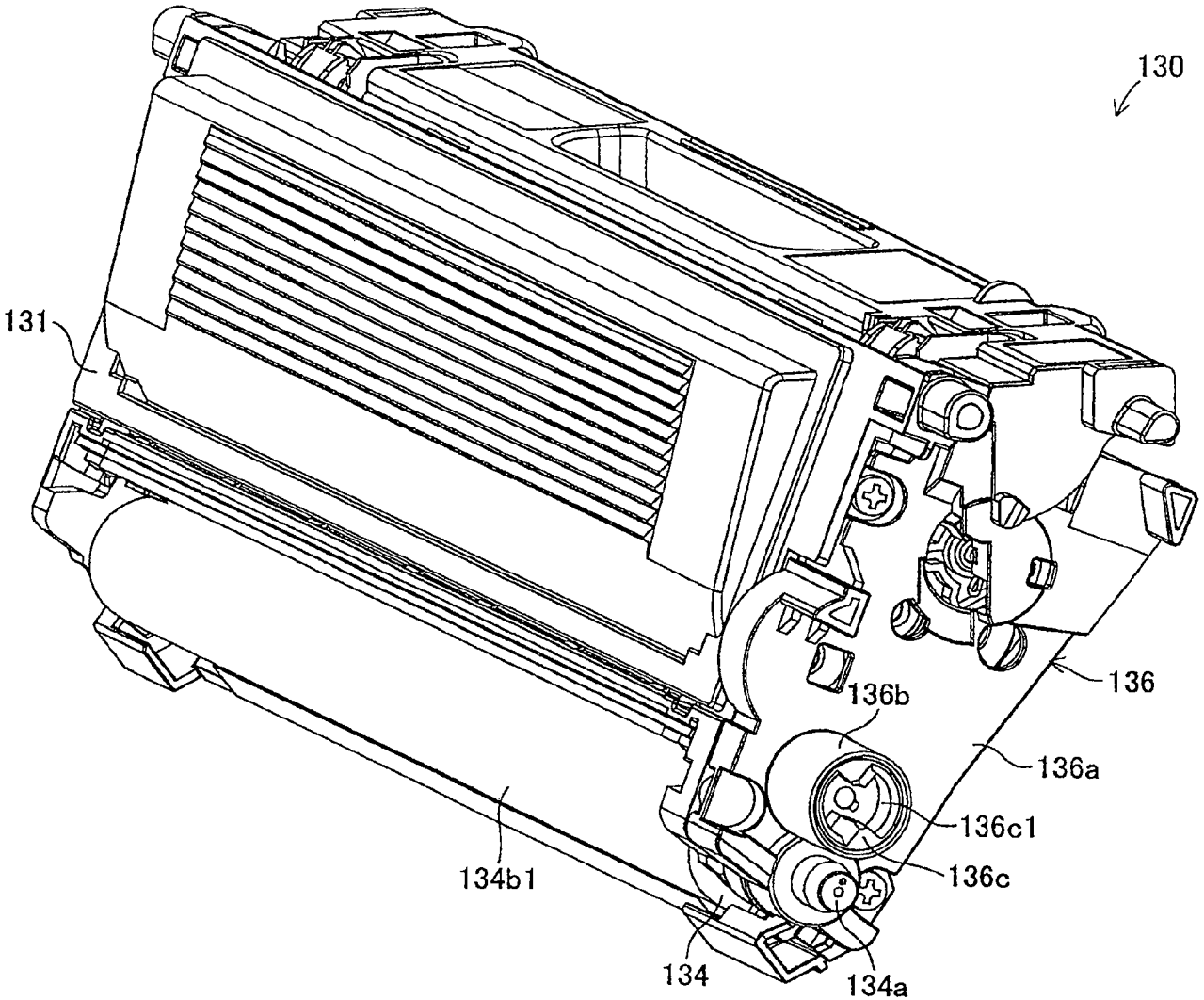
FIG. 6 is a perspective view showing the external appearance of the image-forming cartridge shown in FIG. 5 as viewed from the rear side {the far side in FIG. 3).
Figure 7:
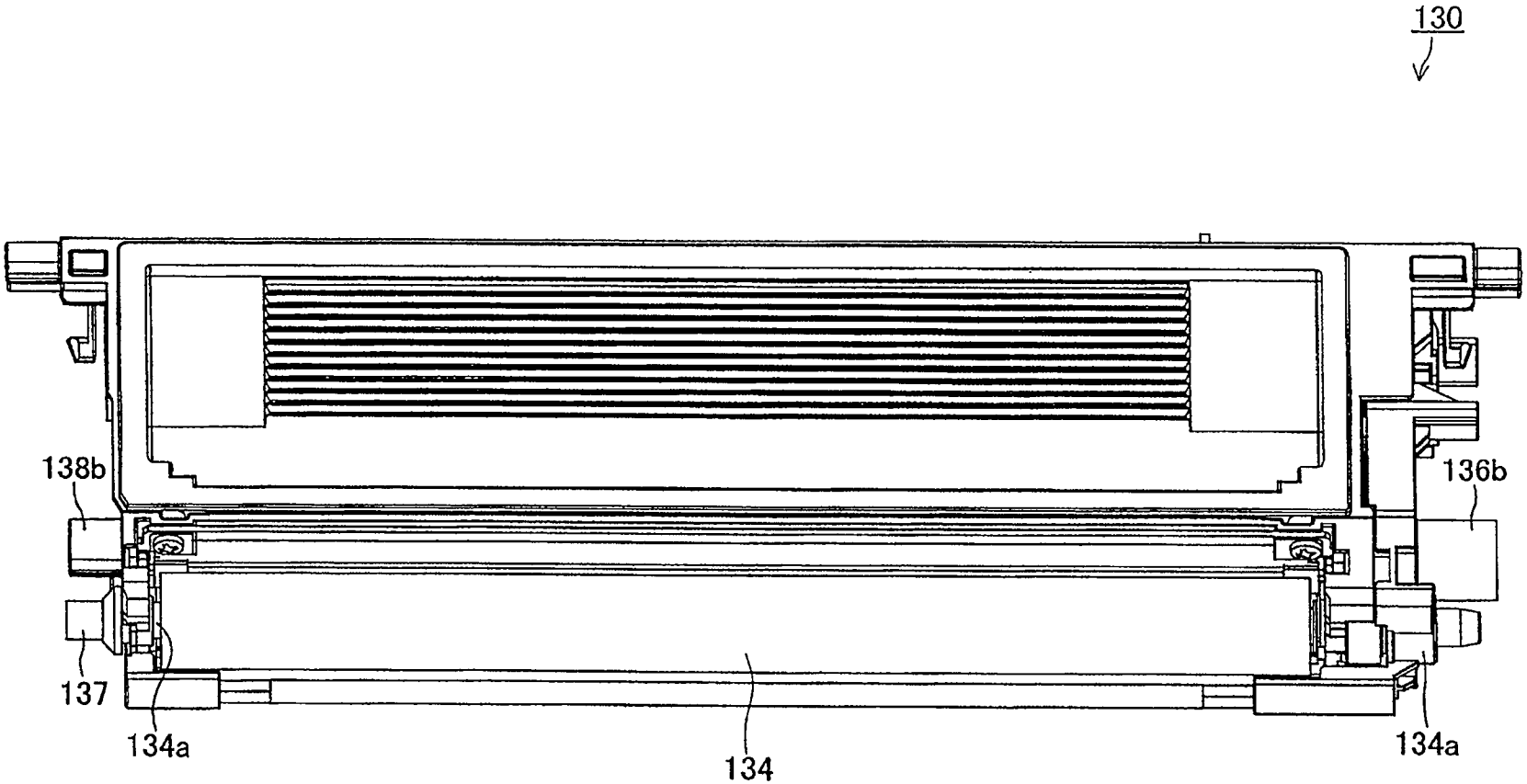
FIG. 7 is a plan view showing the external appearance of the image-forming cartridge shown in FIG. 3 as viewed from the rear side.
Figure 8:
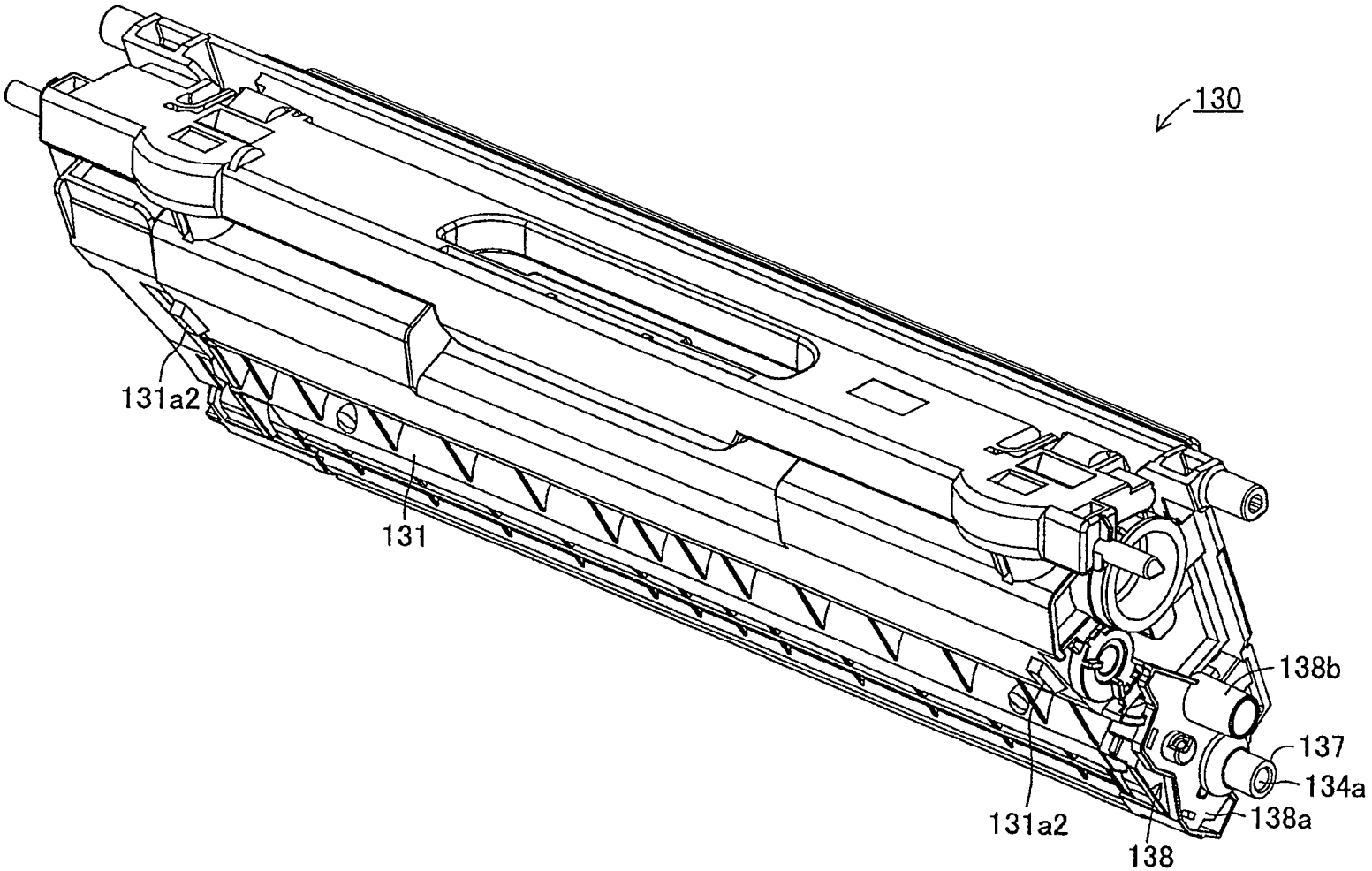
FIG. 8 is a perspective view showing the external appearance of the image-forming cartridge shown in FIG. 5 as viewed from the front side (the near side in FIG. 3).

FIG. 5 is a side view showing the external appearance of the image-forming cartridge 130 shown in FIG. 3. FIG. 5 is a side view corresponding to the sectional view of FIG. 3. FIG. 6 is a perspective view showing the external appearance of the image-forming cartridge 130 shown in FIG. 5 as viewed from the rear side (the far side in FIG. 3). FIG. 7 is a plan view showing the external appearance of the image-forming cartridge 130 shown in FIG. 3 as viewed from the rear side. FIG. 8 is a perspective view showing the external appearance of the image-forming cartridge 130 shown in FIG. 5 as viewed from the front side (the near side in FIG. 3).

Referring to FIGS. 5 and 6, the developing roller 134 is accommodated within the cartridge case 131 in such a manner that a portion of the toner-carrying surface 134*b*1 is exposed to the exterior of the cartridge case 131.

A gear train 136 is disposed at one end portion, with respect to the paper width direction, of the cartridge case 131. The gear train 136 is configured to be capable of transmitting a rotational drive force to the members (the agitator 132, the feed roller 133, and the developing roller 134 shown in FIG. 4) of a rotational drive system provided in the image-forming cartridge 130. The specific configuration of the gear train 136 will be described below.

A gear cover 136*a* is provided in such a manner as to cover the one end portion, with respect to the width direction, of the cartridge case 131. An internal space of the gear cover 136*a*; i.e., a space between the gear cover 136*a* and a side of the cartridge case 131, accommodates gears fixed to end portions of rotating shafts (the agitator-rotating shaft 132*a*, etc. in FIG. 4) of the members of the above-mentioned rotational drive system. These gears are rotatably supported by the gear cover 136*a* and the side of the cartridge case 131.

A thin-walled, cylindrical coupling support sleeve 136*b* is formed in such a manner as to project laterally from the gear cover 136*a*. The coupling support sleeve 136*b* is formed integrally with the gear cover 136*a* with no seam formed therebetween.

The coupling support sleeve 136*b* accommodates a coupling portion 136*c*. The coupling portion 136*c* is rotatably supported by the coupling support sleeve 136*b*. The coupling portion 136*c* has a coupling recess 136*c*1 at an end portion with respect to the paper width direction. That is, the coupling portion 136*c* is accommodated in the coupling support sleeve 136*b* in such a manner that the coupling recess 136*c*1 formed at an end portion of the coupling portion 136*c* is exposed to the exterior of the coupling support sleeve 136*b*.

The coupling portion 136*c* is configured such that the coupling recess 136*c*1 and an unillustrated coupling input shaft provided in the body frame 112 (see FIG. 1) can be engaged together. The coupling portion 136*c* is disposed so as to mesh with the gears fixed to end portions of the members of the above-mentioned rotational drive system. The above-mentioned coupling input shaft is connected to a drive source provided on the outside of the image-forming cartridge 130 (on the body frame 112 in FIG. 1) by means of a plurality of gears. Through engagement of the coupling portion 136*c* and the above-mentioned coupling input shaft, a rotational drive force can be transmitted from the drive source to the members of the above-mentioned rotational drive system via the coupling portion 136*c*.

The one end portion, with respect to the paper width direction, of the developing-roller-rotating shaft 134*a* is provided in such a manner as to be exposed to the exterior of the gear cover 136*a* at a position located below the coupling portion 136*c*.

Referring to FIG. 7, a collar member 137 is provided in such a manner as to cover the other end portion, opposite the one end portion, of the developing-roller-rotating shaft 134*a*. That is, the collar member 137 is provided at an end portion, with respect to the paper width direction, of the image-forming cartridge 130, which end portion is opposite an end portion at which the coupling portion 136*c* is provided.

Referring to FIG. 8, a roller energization member 138 is attached to a side of the cartridge case 131. The roller energization member 138 intervenes between the collar member 137 and the cartridge case 131.

The roller energization member 138 is formed from an electrically conductive synthetic resin (for example, a synthetic resin mixed with carbon black). The roller energization member 138 is electrically connected with the developing-roller-rotating shaft 134*a* (developing roller 134) through contact with the developing-roller-rotating shaft 134*a*.

The roller energization member 138 includes a mounting plate 138*a* and a roller energization terminal portion 138*b*. The mounting plate 138*a* and the roller energization terminal portion 138*b* are formed integrally with each other with no seam formed therebetween.

The mounting plate 138*a* assumes a form resembling a flat plate. The mounting plate 138*a* has a through-hole into which the developing-roller-rotating shaft 134*a* is inserted. The mounting plate 138*a* is electrically connected with the developing-roller-rotating shaft 134*a* through contact with the developing-roller-rotating shaft 134*a*.

The roller energization terminal portion 138*b*, which serves as the image-forming-cartridge contact of the present invention, assumes the form of a projection located above the collar member 137 and projecting laterally from the mounting plate 138*a*. The roller energization terminal portion 138*b* has a cylindrical, external shape.

Schematic Configuration of Slide Frame

Figure 9:
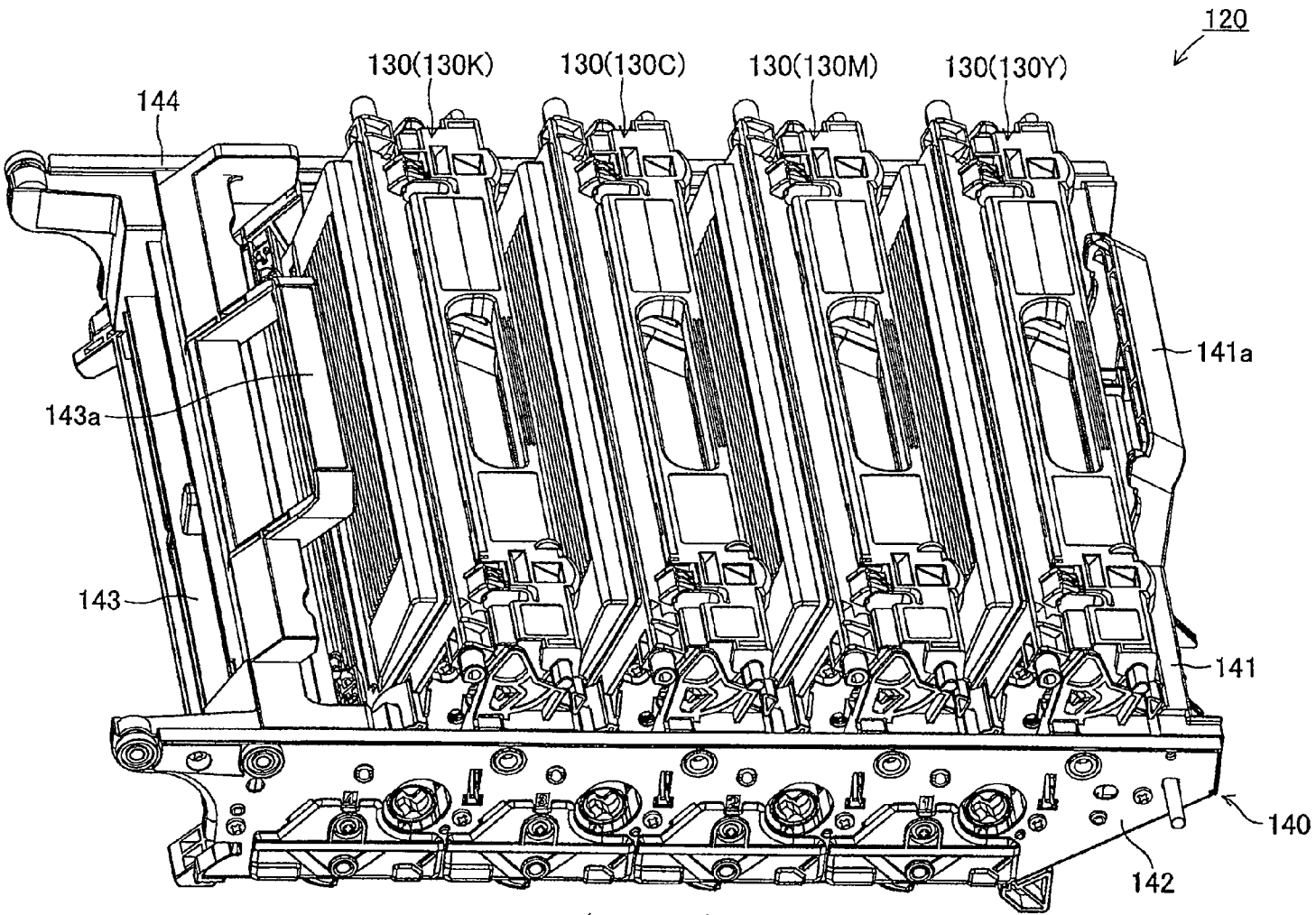
FIG. 9 is a perspective view of the color-image-forming unit shown in FIGS. 1 to 3 as viewed from an obliquely upper point.
Figure 10:
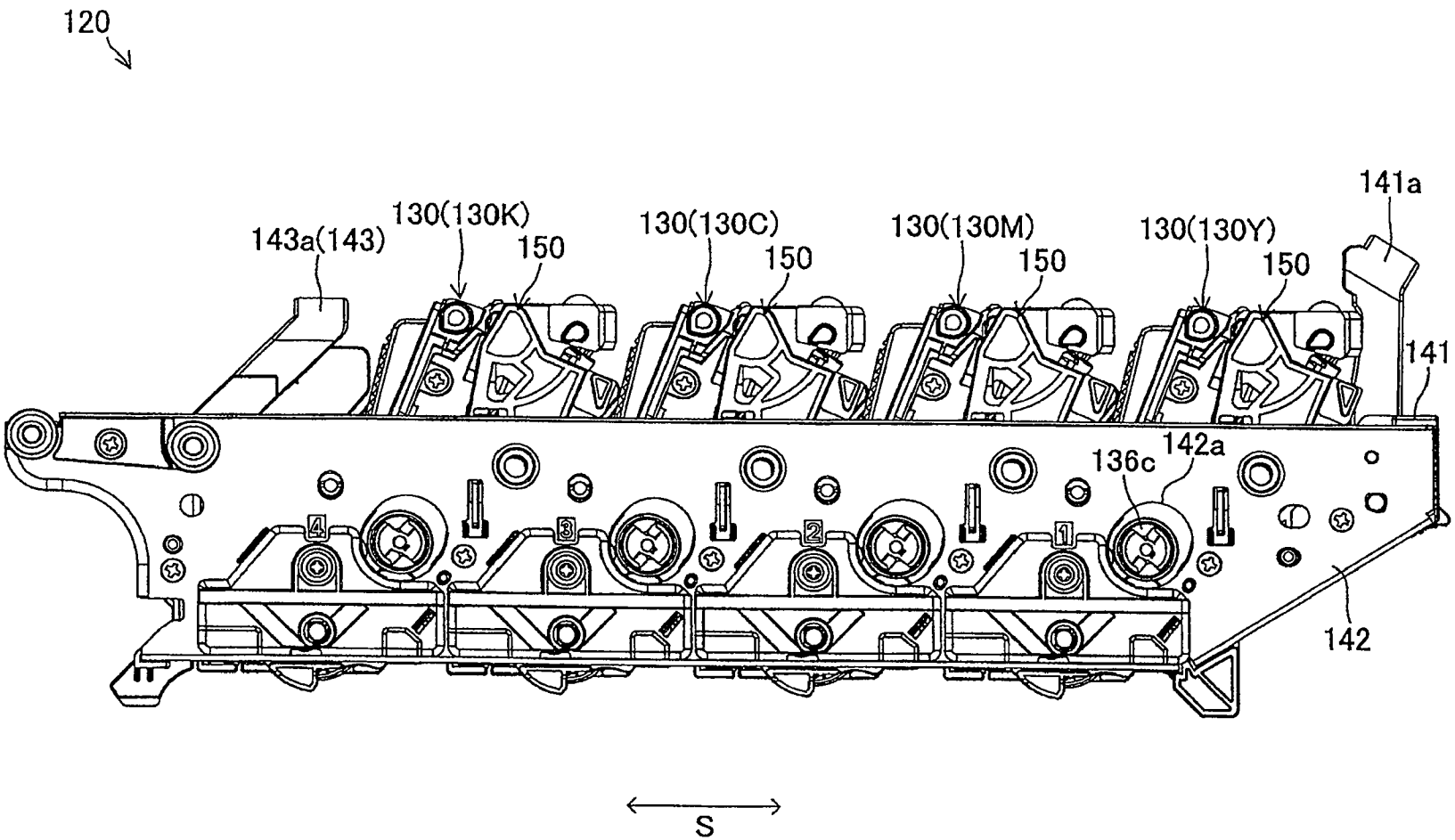
FIG. 10 is a side view of the color-image-forming unit shown in FIG. 9.
Figure 11:
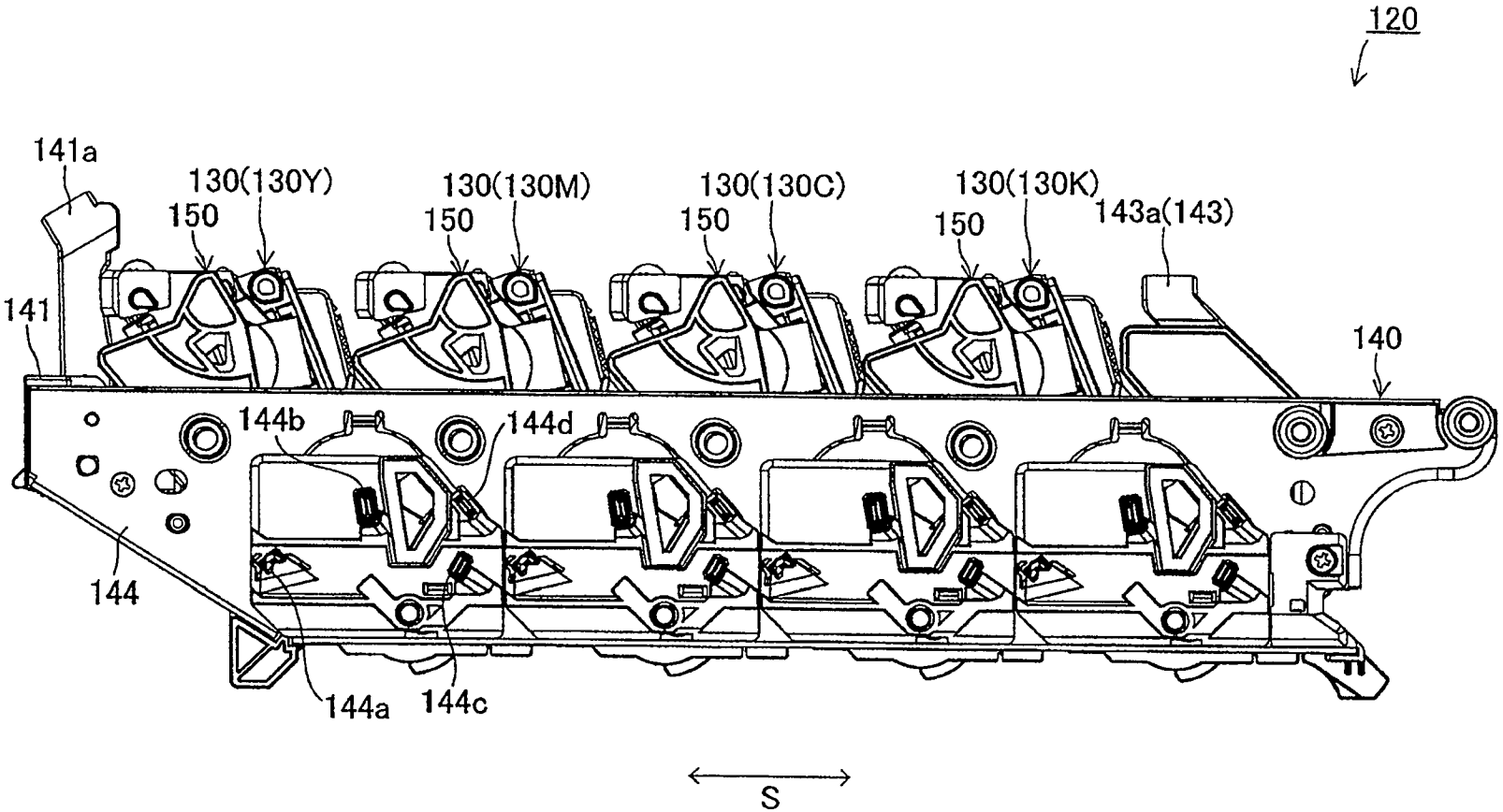
FIG. 11 is a side view of the color-image-forming unit shown in FIG. 9 as viewed from a side opposite that of FIG. 10.
Figure 12:
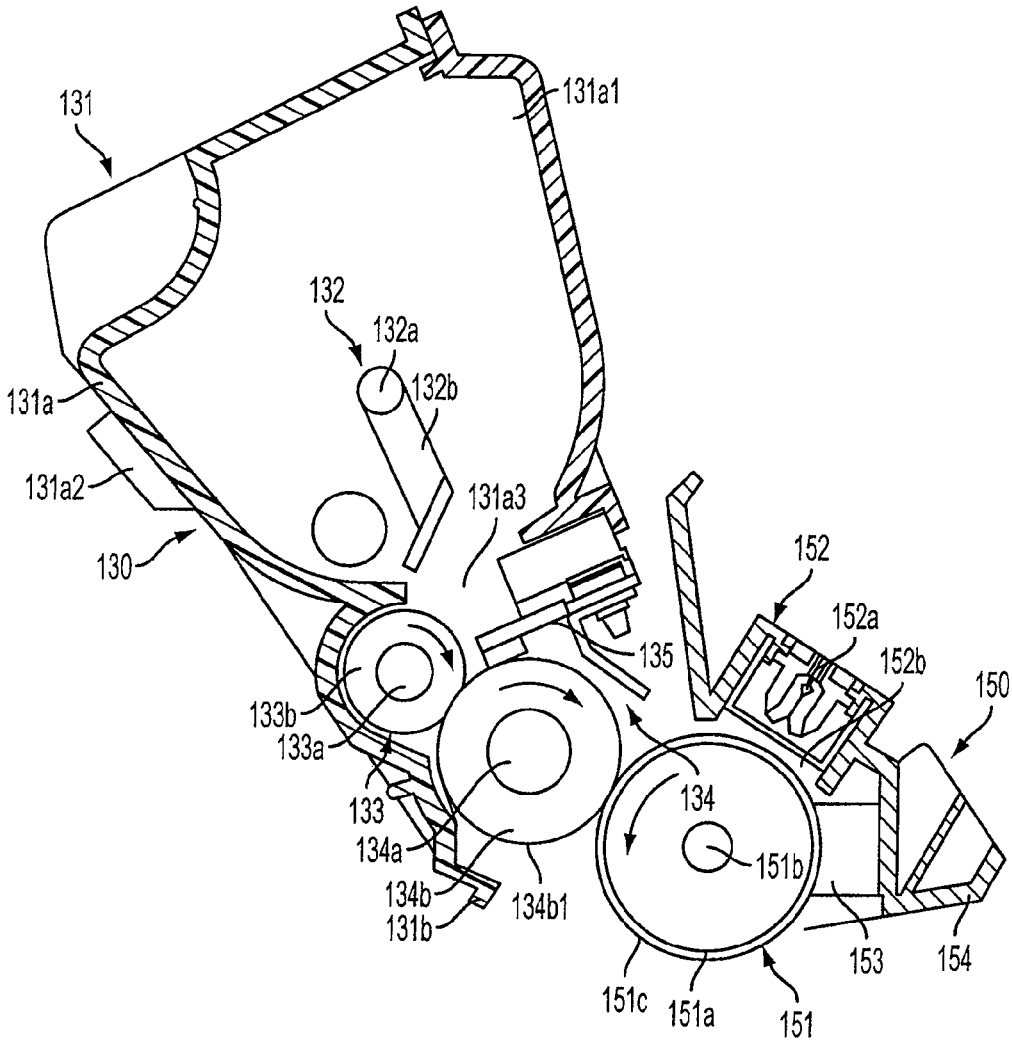
FIG. 12 is a side sectional view showing, on an enlarged scale, the periphery of the image-forming cartridge in a state of attachment to a slide frame shown in FIG. 11.

FIG. 9 is a perspective view of the color-image-forming unit 120 shown in FIGS. 1 to 3 as viewed from an obliquely upper point. FIG. 10 is a side view of the color-image-forming unit 120 shown in FIG. 9. FIG. 11 is a side view of the color-image-forming unit 120 shown in FIG. 9 as viewed from a side opposite that of FIG. 10. FIG. 12 is a side sectional view showing, on an enlarged scale, the periphery of the image-forming cartridge 130 in a state of attachment to the slide frame 140 shown in FIG. 11.

Referring to FIG. 9, the slide frame 140, which serves as the image-forming-cartridge support member of the present invention, is configured to be capable of supporting a yellow-image-forming cartridge 130Y, a magenta-image-forming cartridge 130M, a cyan-image-forming cartridge 130C, and a black-image-forming cartridge 130K which are arranged along the slide direction S in this order from the front side (right-hand side in FIG. 9) to the rear side (left-hand side in FIG. 9).

The yellow-image-forming cartridge 130Y is the image-forming cartridge 130 which has the above-mentioned configuration and contains a yellow toner. Similarly, the magenta-image-forming cartridge 130M contains a magenta toner. The same convention also applies to the cyan-image-forming cartridge 130C and the black-image-forming cartridge 130K.

A front beam 141 is provided at the front of the slide frame 140. The front beam 141 is disposed along the paper width direction. A front handle 141*a* is provided above the front beam 141 in an upwardly projecting manner.

A first side plate 142, which serves as the support plate of the present invention, is connected to one end portion, with respect to the paper width direction, of the front beam 141. The first side plate 142 is disposed perpendicular to a horizontal plane and in parallel with the slide direction S.

Referring to FIG. 10, the first side plate 142 has a plurality of coupling exposure holes 142*a*, which are through-holes. The coupling exposure holes 142*a* are provided along the slide direction S in corresponding relation with the arrangement of the image-forming cartridges 130. The coupling exposure holes 142*a* are formed such that the coupling portions 136*c* of the image-forming cartridges 130 can be exposed to the exterior of the slide frame 140 along the paper width direction.

Referring to FIG. 9, a rear beam 143 is provided at the rear of the slide frame 140. The rear beam 143 is disposed in parallel with the front beam 141. The first side plate 142 is connected to one end portion, with respect to the paper width direction, of the rear beam 143. A rear handle 143*a* is provided above the rear beam 143 in an upwardly projecting manner.

A second side plate 144, which serves as the support plate of the present invention, is connected to the other end portions, with respect to the paper width direction and different from the one end portions, of the front beam 141 and the rear beam 143, respectively. The second side plate 144 is disposed in parallel with the first side plate 142.

Referring to FIG. 11, the second side plate 144 has developing-roller power-feed through-holes 144*a*, wire power-feed through-holes 144*b*, grid power-feed through-holes 144*c*, and cleaner power-feed through-holes 144*d*. A plurality of the developing-roller power-feed through-holes 144*a*, the wire power-feed through-holes 144*b*, the grid power-feed through-holes 144*c*, and the cleaner power-feed through-holes 144*d* are provided along the slide direction S in corresponding relation with the arrangement of the image-forming cartridges 130.

The developing-roller power-feed through-holes 144*a* are formed such that electrode terminals for feeding power to the respective developing rollers 134 (see FIG. 12) of the image-forming cartridges 130 can be exposed. The wire power-feed through-holes 144*b*, the grid power-feed through-holes 144*c*, and the cleaner power-feed through-holes 144*d* are formed such that electrode terminals for feeding power to respective members provided in drum units 150 attached to the slide frame 140 can be exposed.

Configuration of Drum Unit

A plurality of the drum units 150, which collectively serve as the image-forming-cartridge support member of the present invention, are provided along the slide direction S in corresponding relation with the arrangement of the image-forming cartridges 130. Each of the drum units 150 is configured such that the image-forming cartridge 130 can be removably attached thereto.

Referring to FIG. 12, the drum unit 150 has a photoconductor drum 151, which serves as the electrostatic-latent-image-carrying body of the present invention. The photoconductor drum 151 includes a drum body 151*a* and a photoconductor-drum-rotating shaft 151*b*.

The drum body 151*a* includes a sleeve made of a metal and a photoconductor layer, which is a photoconductive resin layer formed on an outer surface of the sleeve. The outer circumferential surface of the photoconductor layer serves as an electrostatic-latent-image-forming surface 151*c*. The photoconductor-drum-rotating shaft 151*b* is a rodlike member made of a metal and is provided such that opposite end portions thereof project to the exterior of the drum body 151*a*.

The photoconductor-drum-rotating shaft 151*b* and the drum body 151*a* are jointed together at end portions of the drum body 151*a*, thereby being electrically connected together. That is, the developing roller 134 and the photoconductor drum 151 are configured such that a predetermined developing bias voltage can be applied between the toner-carrying surface 134*b*1 of the developing roller 134 and the drum body 151*a* of the photoconductor drum 151.

A scorotron charger 152 is disposed upstream of a position where the photoconductor drum 151 and the developing roller 134 face each other (are proximate to each other), with respect to the direction of rotation (direction indicated by the arrow in FIG. 12) of the photoconductor drum 151. The scorotron charger 152 is disposed to face the electrostatic-latent-image-forming surface 151*c* of the photoconductor drum 151 with a predetermined gap present therebetween.

The scorotron charger 152 includes a discharge wire 152*a* and a grid 152*b*. The discharge wire 152*a* and the grid 152*b* are electrically connected to a high-voltage power source which outputs a predetermined high voltage. The scorotron charger 152 is configured to be capable of uniformly charging the electrostatic-latent-image-forming surface 151*c* of the photoconductor drum 151 by means of the high-voltage power source outputting the predetermined high voltage to the discharge wire 152*a* and to the grid 152*b*.

A drum cleaner 153 for cleaning the electrostatic-latent-image-forming surface 151*c* is disposed upstream of a position where the photoconductor drum 151 and the scorotron charger 152 face each other (are proximate to each other), with respect to the direction of rotation (direction indicated by the arrow in FIG. 12) of the photoconductor drum 151. The drum cleaner 153 has a brush formed from an electrically conductive synthetic resin and is configured to be capable of electrically adsorbing residual toner, dust, and the like on the electrostatic-latent-image-forming surface 151*c* by means of a predetermined cleaning bias voltage being applied between the brush and the electrostatic-latent-image-forming surface 151*c*. The drum cleaner 153 is also electrically connected to the high-voltage power source which outputs a predetermined high voltage.

The scorotron charger 152 and the drum cleaner 153 are supported by a drum-unit main frame 154 made of a synthetic resin, so as to be disposed at respectively predetermined positions.

Configuration for Positioning Between Drum Unit and Image-Forming Cartridge

The drum unit 150 is configured such that the image-forming cartridge 130 can be attached thereto/detached therefrom along a predetermined cartridge insertion direction orthogonal to the slide direction S. Also, the drum unit 150 is configured such that the image-forming cartridge 130 can be positioned in relation to the photoconductor drum 151. Specifically, the drum unit 150 is configured such that, in a state in which the image-forming cartridge 130 is attached to the drum unit 150, the toner-carrying surface 134*b*1 of the developing roller 134 and the electrostatic-latent-image-forming surface 151*c* of the photoconductor drum 151 are in parallel with each other and in a predetermined positional relation with each other.

Figure 13:
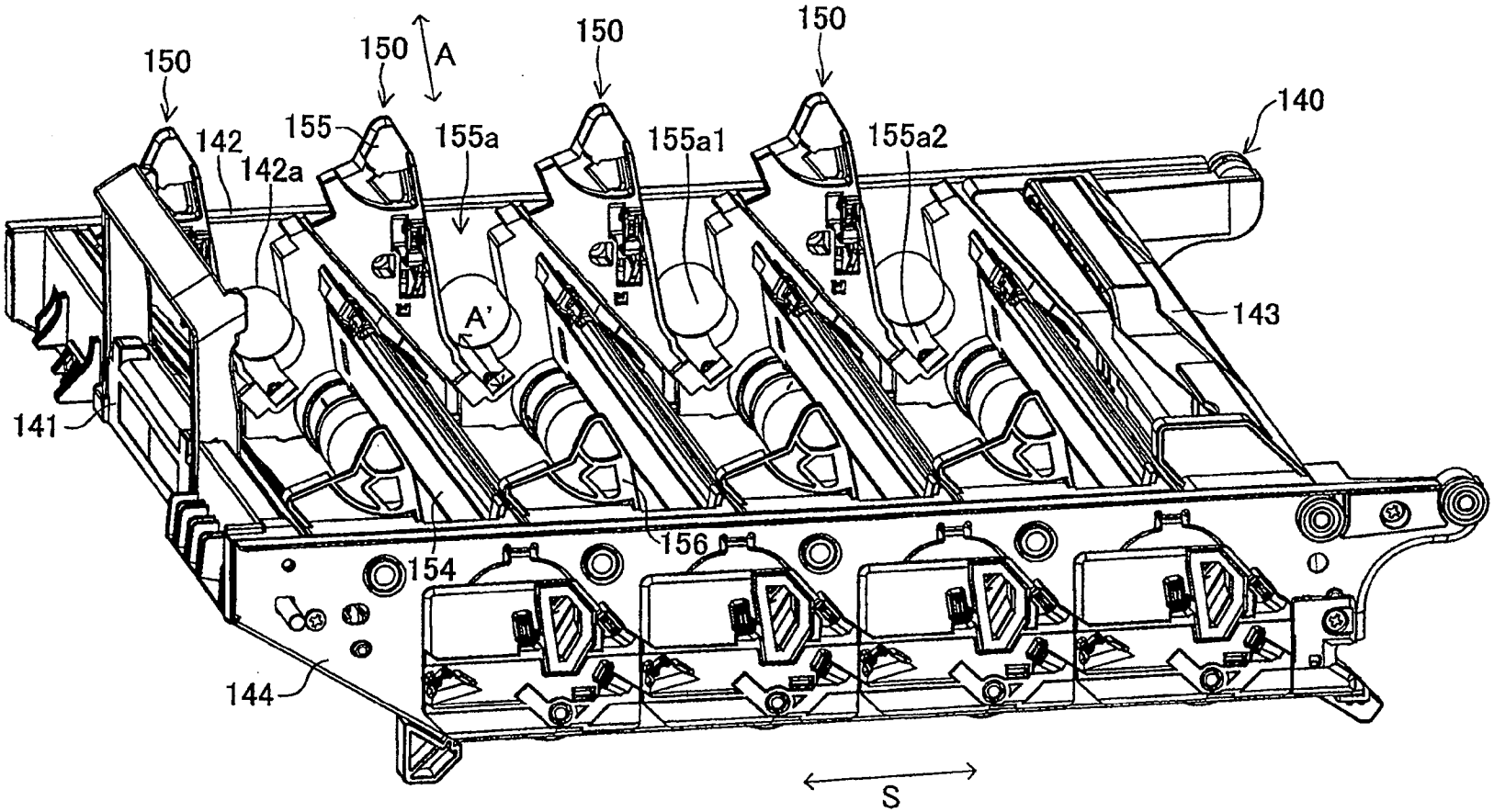
FIG. 13 is a perspective view showing a state in which the image-forming units are removed from the color-image-forming unit shown in FIG. 11.
Figure 14:
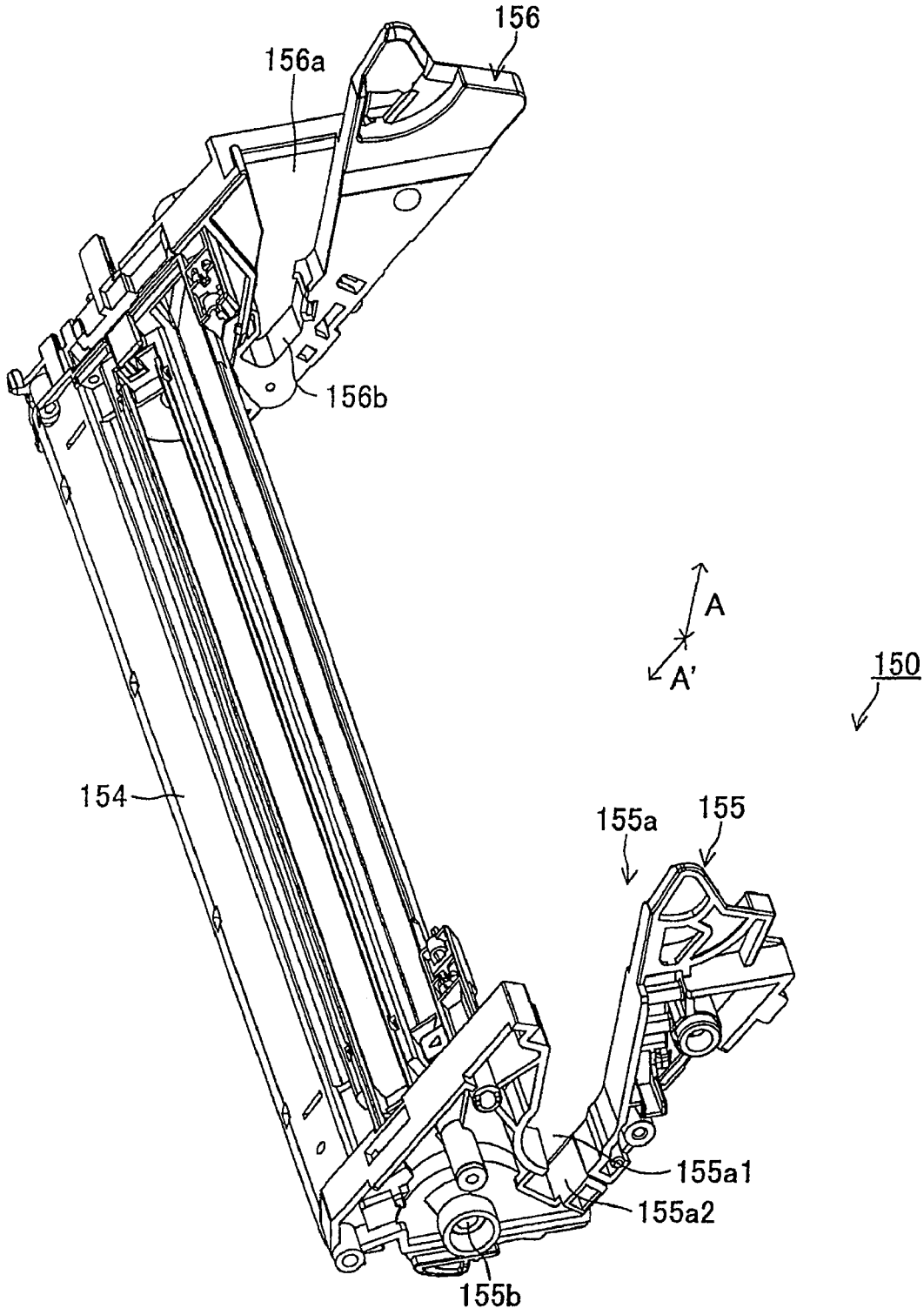
FIG. 14 is a perspective view of a drum unit shown in FIG. 13.

FIG. 13 is a perspective view showing a state in which the image-forming cartridges 130 are removed from the color-image-forming unit 120 shown in FIG. 11. FIG. 14 is a perspective view of the drum unit 150 shown in FIG. 13.

Referring to FIGS. 13 and 14, a first drum-unit side frame 155, which serves as the side plate of the present invention, is connected to one end, with respect to the paper width direction, of the drum-unit main frame 154. The first drum-unit side frame 155 is attached to the inner side of the first side plate 142 of the slide frame 140. In the present embodiment, the first drum-unit side frames 155 in a number of four are arranged along the slide direction S in corresponding relation with the four coupling exposure holes 142*a*.

A coupling guide groove 155*a* is formed in the first drum-unit side frame 155. The coupling guide groove 155*a* is formed along a cartridge attachment/detachment direction A orthogonal to the slide direction S. The coupling guide groove 155*a* is formed into such a width as to be capable of receiving the coupling support sleeve 136*b* (see FIG. 6) of the image-forming cartridge 130.

A coupling-receiving portion 155*a*1 is formed at a lower end portion of the coupling guide groove 155*a*. The coupling-receiving portion 155*a*1 is formed to be capable of receiving the coupling support sleeve 136*b* (see FIG. 6) of the image-forming cartridge 130 while allowing the coupling support sleeve 136*b* to be exposed to the exterior of the first drum-unit side frame 155. As shown in FIG. 13, the coupling-receiving portion 155*a*1 is formed in such a manner as to coincide with the coupling exposure hole 142*a* of the first side plate 142 as viewed laterally.

Referring to FIGS. 13 and 14, a developing-roller guide groove 155*a*2 is formed in such a manner as to extend obliquely downward from the coupling-receiving portion 155*a*1. The developing-roller guide groove 155*a*2 is formed along a positioning direction A', which is orthogonal to the slide direction S and forms a relatively small angle (about 20° to 30°) with the cartridge attachment/detachment direction A. The developing-roller guide groove 155*a*2 is formed to have a width equivalent to the developing-roller-rotating shaft 134*a* (see FIG. 6) of the image-forming cartridge 130 so as to be capable of receiving the developing-roller-rotating shaft 134*a*.

Referring to FIG. 14, a drum-shaft insertion hole 155*b* is formed at a lower portion of the first drum-unit side frame 155 and at a position located obliquely downward of the coupling-receiving portion 155*a*1 along the positioning direction A'. The photoconductor-drum-rotating shaft 151*b* (see FIG. 12) is inserted into the drum-shaft insertion hole 155*b*.

Referring to FIGS. 13 and 14, a second drum-unit side frame 156, which serves as the side plate of the present invention, is connected to the other end, with respect to the paper width direction and opposite the one end, of the drum-unit main frame 154. The second drum-unit side frame 156 is attached to the inner side of the second side plate 144 of the slide frame 140. In the present embodiment, the second drum-unit side frames 156 in a number of four are arranged along the slide direction S in corresponding relation with the four first drum-unit side frames 155.

Figure 15I:
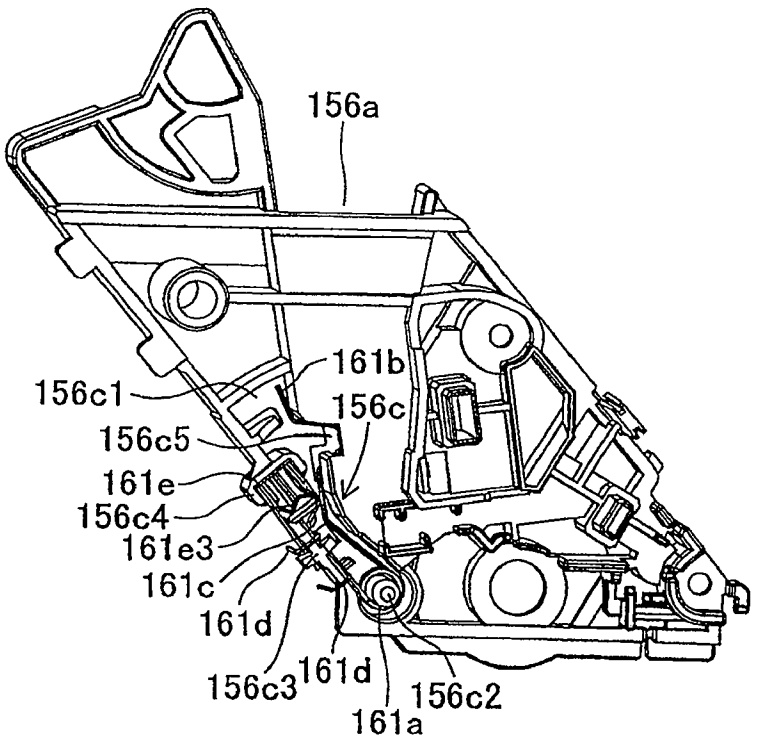
FIG. 15 is a pair of perspective views of a second drum-unit side frame shown in FIG. 14.
Figure 15I:
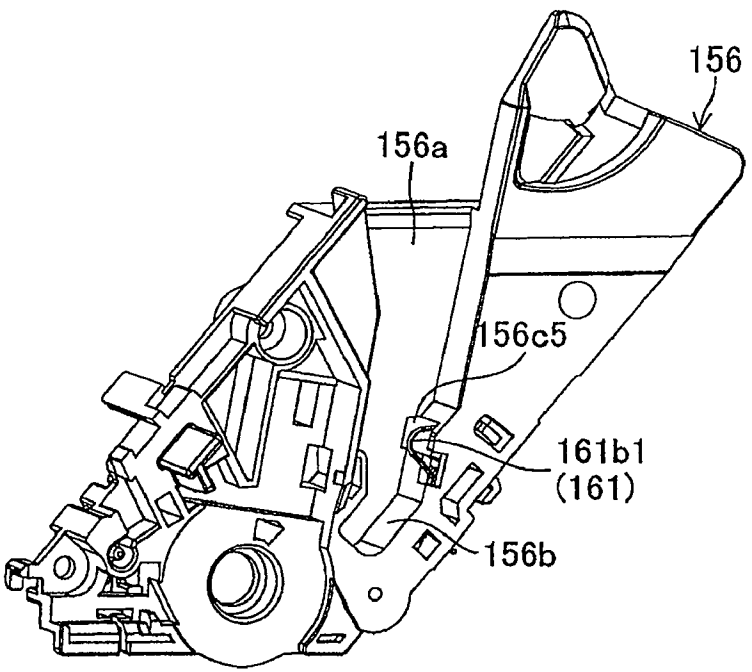

FIG. 15 is a pair of perspective views of the second drum-unit side frame 156 shown in FIG. 14, wherein (i) is a view of the second drum-unit side frame 156 as viewed from the inside (from a side toward the drum-unit main frame 154 in FIG. 14), and (ii) is a view of the second drum-unit side frame 156 as viewed from the outside.

Referring to FIGS. 13, 14, and 15(*i*), a roller-energization-terminal-portion guide groove 156*a*, which serves as the guide portion of the present invention, is formed on the inner side of the second drum-unit side frame 156. The roller-energization-terminal-portion guide groove 156*a* is formed along the cartridge attachment/detachment direction A. The coupling guide groove 155*a* is formed to have such a width as to be capable of receiving the collar member 137 and the roller energization terminal portion 138*b* (see FIG. 7) of the image-forming cartridge 130.

A collar guide groove 156*b* is formed at a lower end portion of the roller-energization-terminal-portion guide groove 156*a*. The collar guide groove 156*b* is formed to have a width equivalent to the collar member 137 (see FIG. 7) of the image-forming cartridge 130 so as to be capable of receiving the collar member 137. The collar guide groove 156*b* is formed along the positioning direction A'.

Configuration For Power Feed to Developing Roller and Drum Unit

Referring to FIG. 15(H), a developing-electrode support portion 156*c* is formed on the outer side of the second drum-unit side frame 156.

The developing-electrode support portion 156*c* has a developing-electrode-accommodating recess 156*c*1. A first-coil-spring support portion 156*c*2, which is a substantially columnar projection, is formed in such a manner as to project outward from the developing-electrode-accommodating recess 156*c*1 along the paper width direction. An engagement portion 156*c*3, which is a plate-like projection, is formed at an outer edge of the developing-electrode-accommodating recess 156*c*1 and at a position located obliquely upward of the first-coil-spring support portion 156*c*2. A second-coil-spring support portion 156*c*4, which is a member having a shape resembling the letter U, is formed above the engagement portion 156*c*3. A terminal exposure hole 156*c*5 is formed in the vicinity of the second-coil-spring support portion 156*c*4 so as to establish communication between the developing-electrode-accommodating recess 156*c*1 and the roller-energization-terminal-portion guide groove 156*a*.

A developing electrode member 161, which serves as the first electrode member of the present invention, is supported in the developing-electrode support portion 156*c*. The developing electrode member 161 is formed integrally from a spring steel wire.

Figure 16:
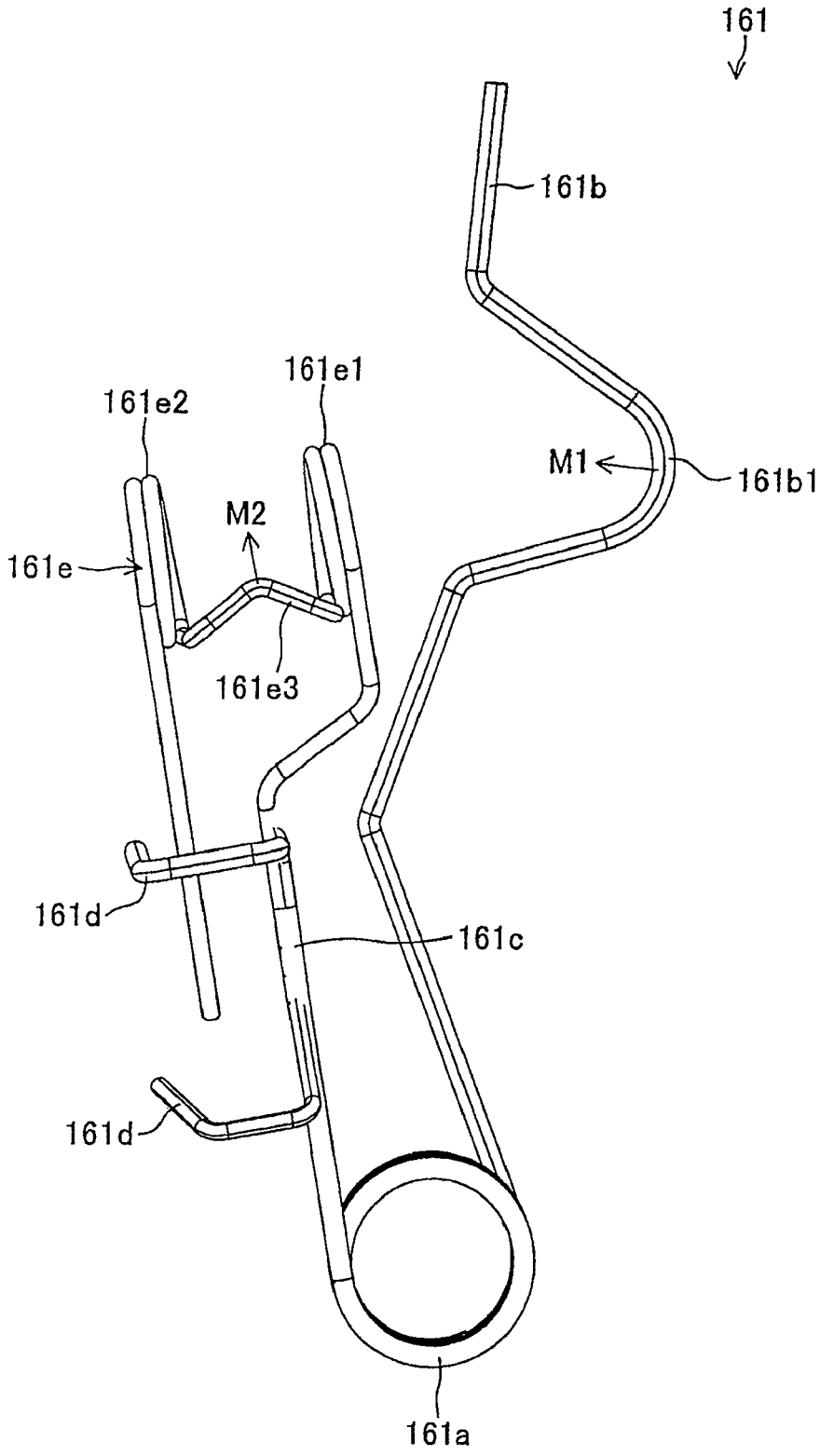
FIG. 16 is an enlarged side view of a developing electrode member shown FIG. 15.

FIG. 16 is an enlarged side view of the developing electrode member 161 shown FIG. 15. Referring to FIGS. 15(ii) and 16, a first coil spring portion 161*a*, which serves as the connection portion and the coil portion of the present invention, is provided at a lower end portion of the developing electrode member 161. The first coil spring portion 161*a* assumes the form of a torsional coil spring whose center axis is in parallel with the paper width direction. The first coil spring portion 161*a* is supported by the first-coil-spring support portion 156*c*2, which is a substantially columnar projection.

A cartridge-side terminal 161*b*, which serves as the arm portion of the present invention, is connected to one end of the first coil spring portion 161*a*. The cartridge-side terminal 161*b* is formed to be capable of oscillating, within the developing-electrode-accommodating recess 156*c*1, with respect to the first coil spring portion 161*a* (first-coil-spring support portion 156*c*2) in a direction indicated by an arrow M1 in FIG. 16. The cartridge-side terminal 161*b* has a bend portion 161*b*1, which serves as the first cartridge-side contact of the present invention and is formed at a position biased toward its distal end. As shown in FIG. 15(*i*), the bend portion 161*b*1 assumes the form of a wire bend portion which projects toward the roller-energization-terminal-portion guide groove 156*a* so as to be capable of being exposed to the interior of the roller-energization-terminal-portion guide groove 156*a* through the terminal exposure hole 156*c*5.

A body-side terminal 161*c* is connected to the other end of the first coil spring portion 161*a*. The body-side terminal 161*c* has a terminal latch projection 161*d* provided at an intermediate position between its distal end portion and the first coil spring portion 161*a*. The terminal latch projection 161*d* is formed into a shape resembling the letter U such that a bottom portion of the shape projects outward from the body-side terminal 161*c* along the paper width direction. The terminal latch projection 161*d* is latched by the engagement portion 156*c*3.

The body-side terminal 161*c* has a second coil spring portion 161*e* provided at its distal end portion. The second coil spring portion 161*e* assumes the form of a torsional coil spring whose center axis is perpendicular to the paper width direction. The second coil spring portion 161*e* is supported by the second-coil-spring support portion 156*c*4.

The second coil spring portion 161*e* has two subcoil springs; i.e., a sub coil spring 161*e*1 and a sub coil spring 161*e*2, which are wound in opposite directions. A first body-side contact 161*e*3 is provided between the sub coil spring 161*e*1 and the sub coil spring 161*e*2. The second coil spring portion 161*e* is configured such that the first body-side contact 161*e*3 can oscillate in a direction indicated by an arrow M2 in FIG. 16 by means of elastic deformation of the sub coil spring 161*e*1 and the sub coil spring 161*e*2.

The second drum-unit side frame 156 and the developing electrode member 161 are configured such that the developing electrode member 161 is readily attachable to/detachable from the developing-electrode support portion 156*c*. Specifically, when the cartridge-side terminal 161*b* or the first body-side contact 161*e*3 of the developing electrode member 161 is plastically deformed unpreparedly by an external force, the developing electrode member 161 can be readily replaced with a new one.

Figure 17:
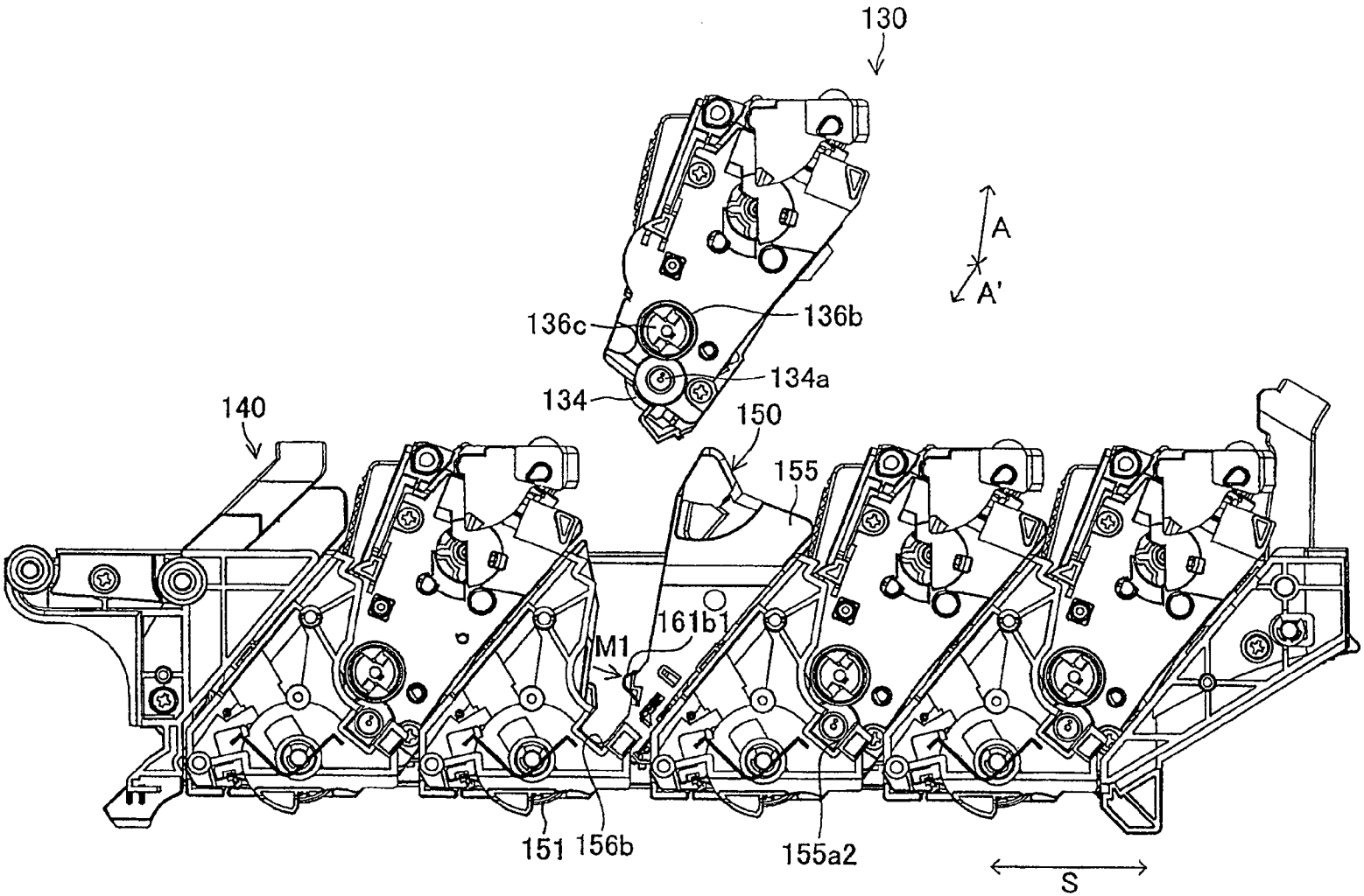
FIG. 17 is a side view showing the internal configuration of the color-image-forming unit shown in FIG. 11.
Figure 18:
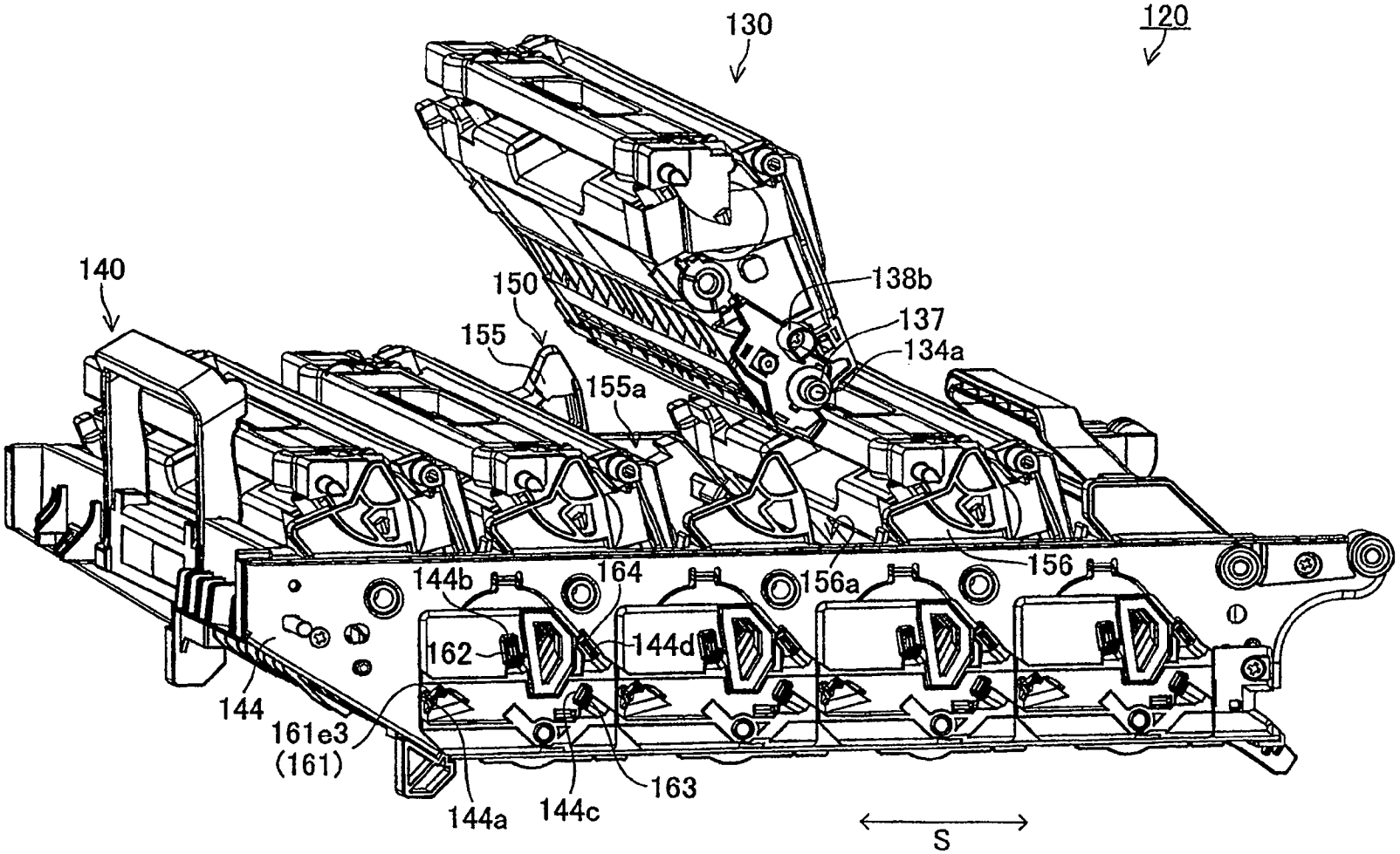
FIG. 18 is a perspective view showing a state of attachment of the image-forming cartridge to the slide frame shown in FIG. 13.

FIG. 17 is a side view showing the internal configuration of the color-image-forming unit 120 shown in FIG. 11. FIG. 17 shows a state of attachment of the image-forming cartridge 130 to a certain drum unit 150 and in which a portion of the first drum-unit side frame 155 other than the first drum-unit side frame 155 of the certain drum unit 150 is seen through. FIG. 18 is a perspective view showing a state of attachment of the image-forming cartridge 130 to the slide frame 140 shown in FIG. 13.

Referring to FIGS. 17 and 18, the image-forming cartridge 130 and the slide frame 140 (drum unit 150) are configured in such a manner that positioning between the developing roller 134 and the photoconductor drum 151 is established by means of inserting the image-forming cartridge 130 such that the collar member 137 attached to one end portion of the developing-roller-rotating shaft 134*a* and the other end portion of the developing-roller-rotating shaft 134*a* butt against the respective lower end portions of the collar guide groove 156*b* and the developing-roller guide groove 155*a*2, which are formed in overlapping relation with each other as viewed laterally.

Also, the image-forming cartridge 130 and the slide frame 140 (drum unit 150) are configured such that, by means of the bend portion 161*b*1 being pressed by the roller energization terminal portion 138*b* in the direction indicated by the arrow M1 in FIG. 17, the bend portion 161*b*1 and the roller energization terminal portion 138*b* come into contact with each other, thereby establishing electrical connection between the developing roller 134 and the first body-side contact 161*e*3. As shown in FIG. 17, the pressing direction M1 between the bend portion 161*b*1 and the roller energization terminal portion 138*b* is a direction along the slide direction S (a direction in parallel with a plane which includes the slide direction S and is perpendicular to the paper width direction; i.e., a direction perpendicular to the paper width direction; the same convention applies to the following description).

Figure 19:
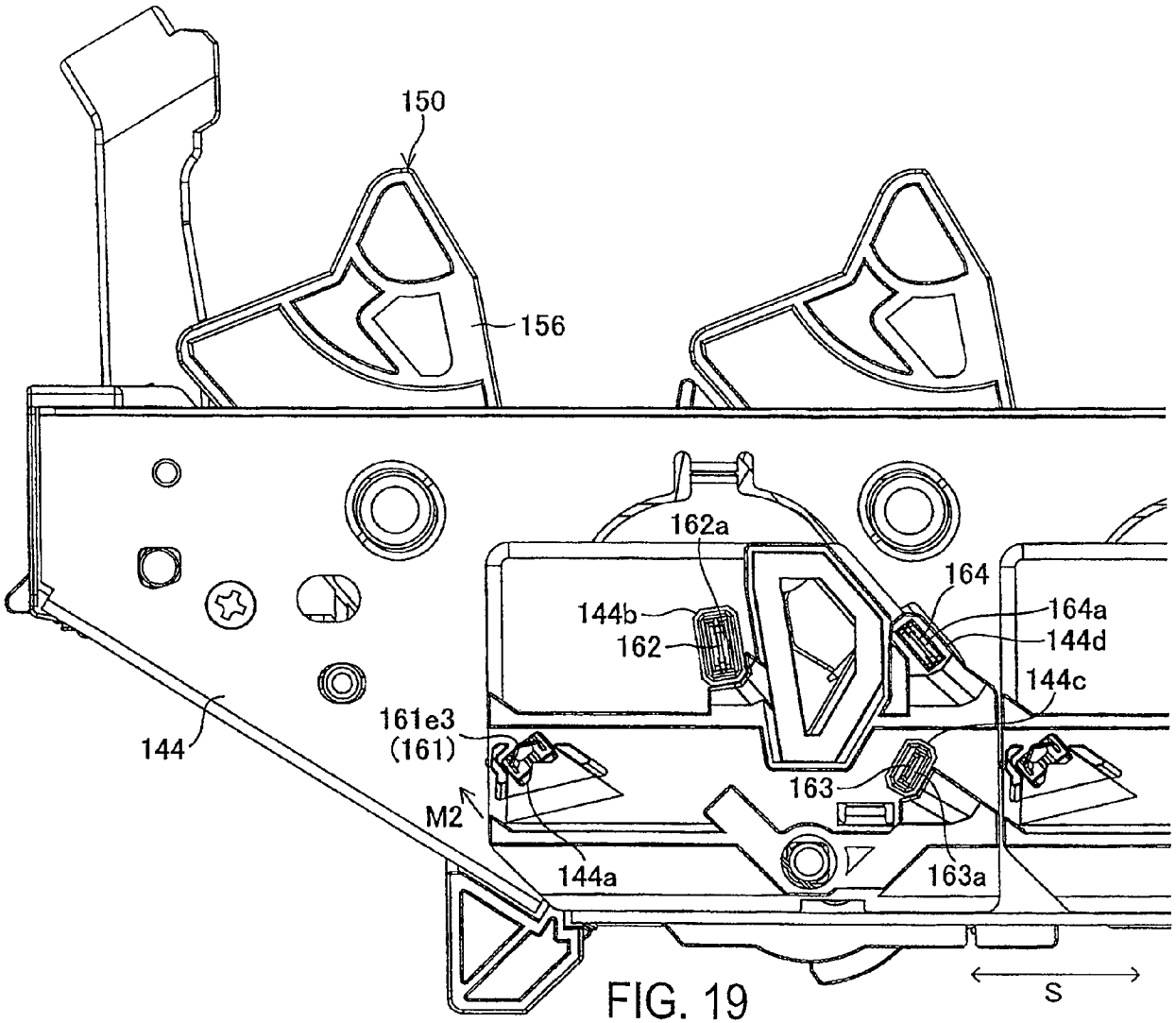
FIG. 19 is a side view showing, on an enlarged scale, the periphery of a first body-side contact shown in FIG. 18.

FIG. 19 is a side view showing, on an enlarged scale, the periphery of the first body-side contact 161*e*3 shown in FIG. 18. Referring to FIGS. 18 and 19, each of the first body-side contacts 161*e*3 is provided in such a manner as to be exposed to the outside of the second side plate 144 through the corresponding developing-roller power-feed through-hole 144*a*. The first body-side contact 161*e*3 is formed to be capable of elastically oscillate when pressed in the direction indicated by the arrow M2 in FIG. 19. As shown in FIG. 19, the direction M2 of pressing the first body-side contact 161*e*3 is along the slide direction S.

Each of wire power-feed electrodes 162, which serve as the second electrode members and as the second body-side contacts of the present invention, is provided in such a manner as to be exposed to the outside of the second side plate 144 through the corresponding wire power-feed through-hole 144*b*. The wire power-feed electrode 162 is electrically connected to the discharge wire 152*a* (see FIG. 12) of the scorotron charger 152. The wire power-feed electrode 162 is supported in an elastically undeformable manner by a support member 162*a* made of a synthetic resin. The support member 162*a* is supported by the second drum-unit side frame.

Each of grid power-feed electrodes 163, which serve as the second electrode members and as the second body-side contacts of the present invention, is provided in such a manner as to be exposed to the outside of the second side plate 144 through the corresponding grid power-feed through-hole 144*c*. The grid power-feed electrode 163 is electrically connected to the grid 152*b* (see FIG. 12) of the scorotron charger 152. The grid power-feed electrode 163 is supported in an elastically undeformable manner by a support member 163*a* made of a synthetic resin. The support member 163*a* is supported by the second drum-unit side frame.

Each of cleaner power-feed electrodes 164, which serve as the second electrode members and as the second body-side contacts of the present invention, is provided in such a manner as to be exposed to the outside of the second side plate 144 through the corresponding cleaner power-feed through-hole 144*d*. The cleaner power-feed electrode 164 is electrically connected to the drum cleaner 153. The cleaner power-feed electrode 164 is supported in an elastically undeformable manner by a support member 164*a* made of a synthetic resin. The support member 164*a* is supported by the second drum-unit side frame.

The developing electrode members 161 (second coil spring portions 161*e*), the wire power-feed electrodes 162, the grid power-feed electrodes 163, and the cleaner power-feed electrodes 164 are arranged along the slide direction S in corresponding relation with the image-forming cartridges 130.

Figure 20:
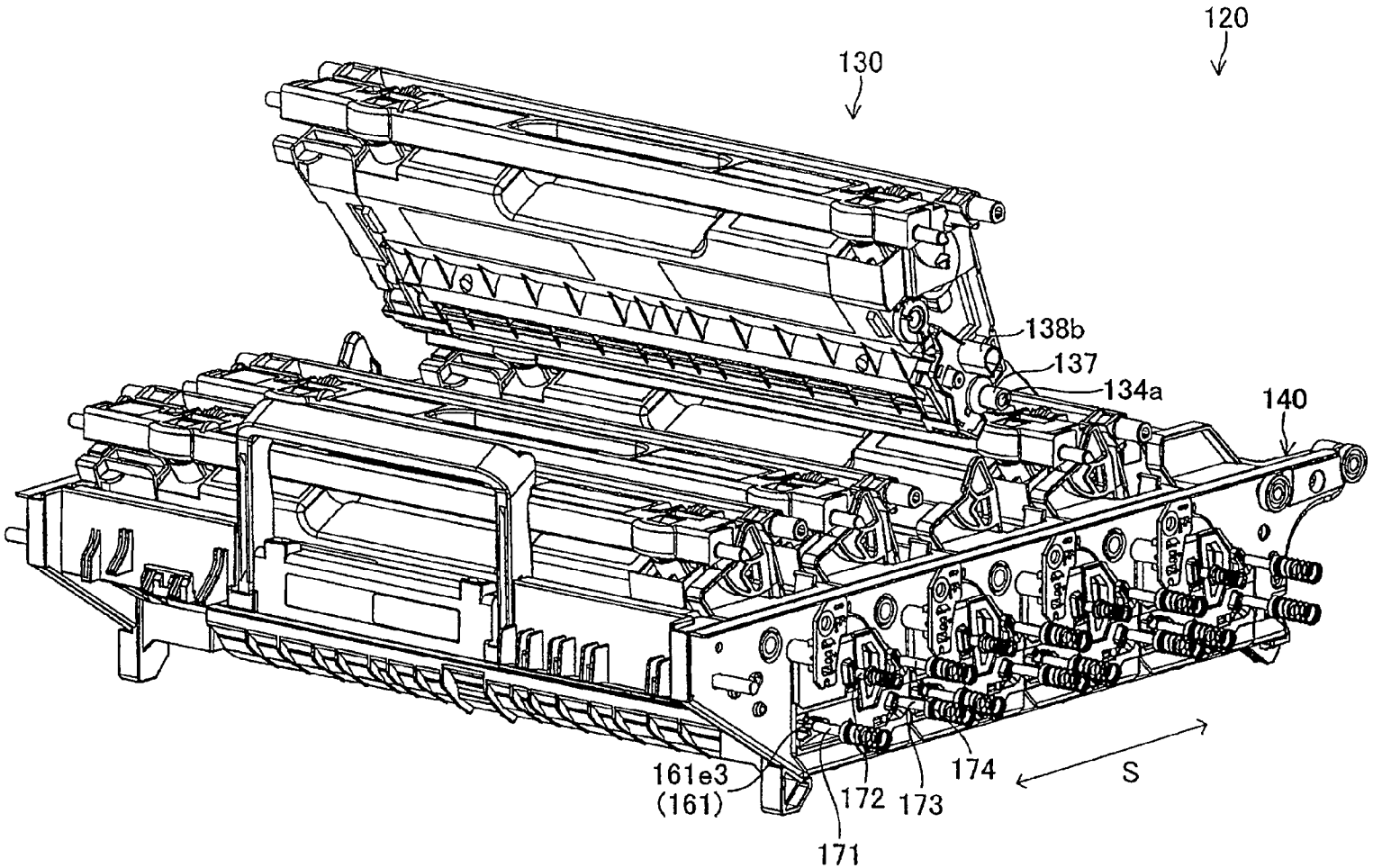
FIG. 20 is a perspective view showing the outline of a configuration for feeding power to the color-image-forming unit shown in FIG. 18.
Figure 21:
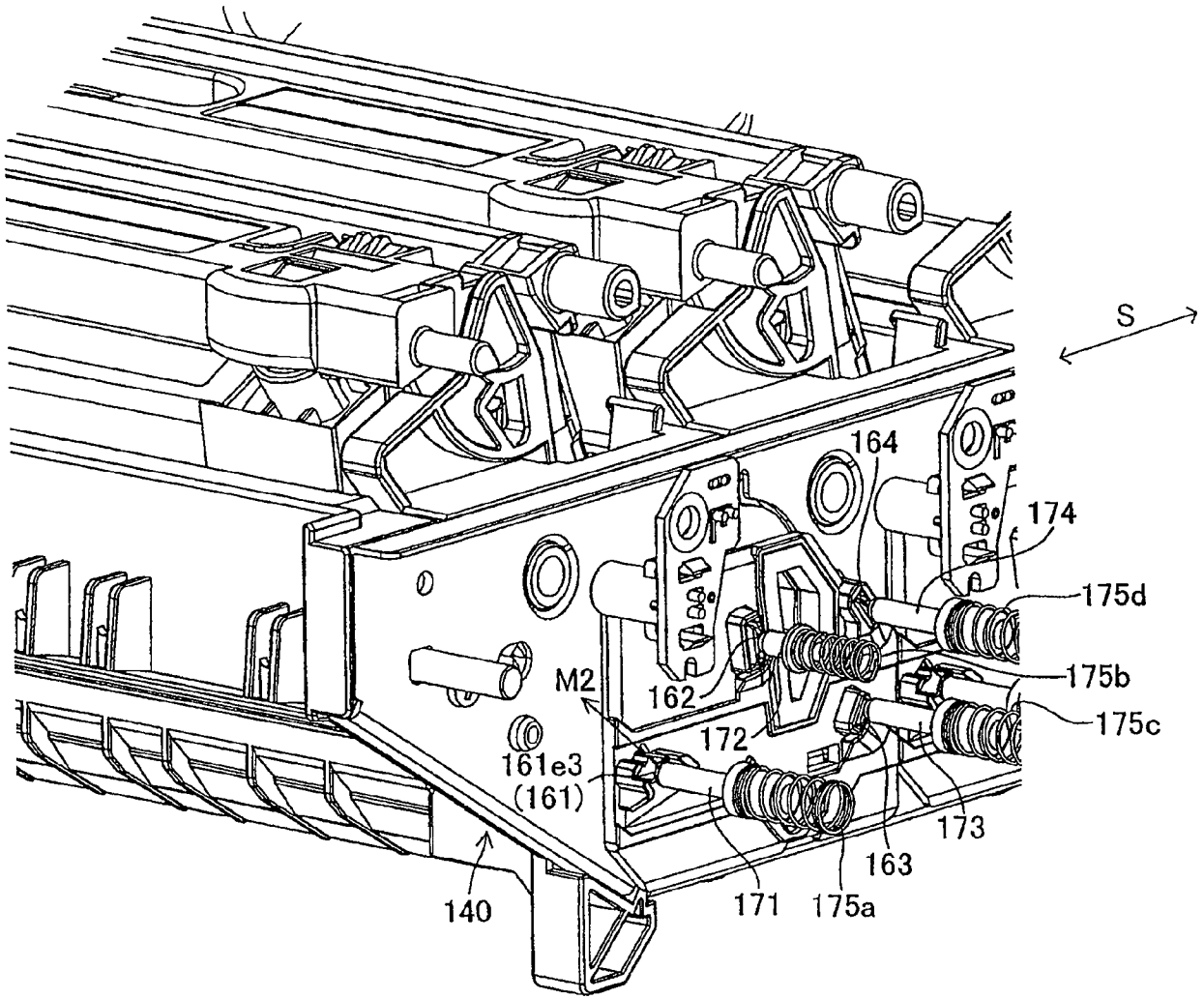
FIG. 21 is a perspective view showing, on an enlarged scale, a portion of FIG. 20.
Figure 22:
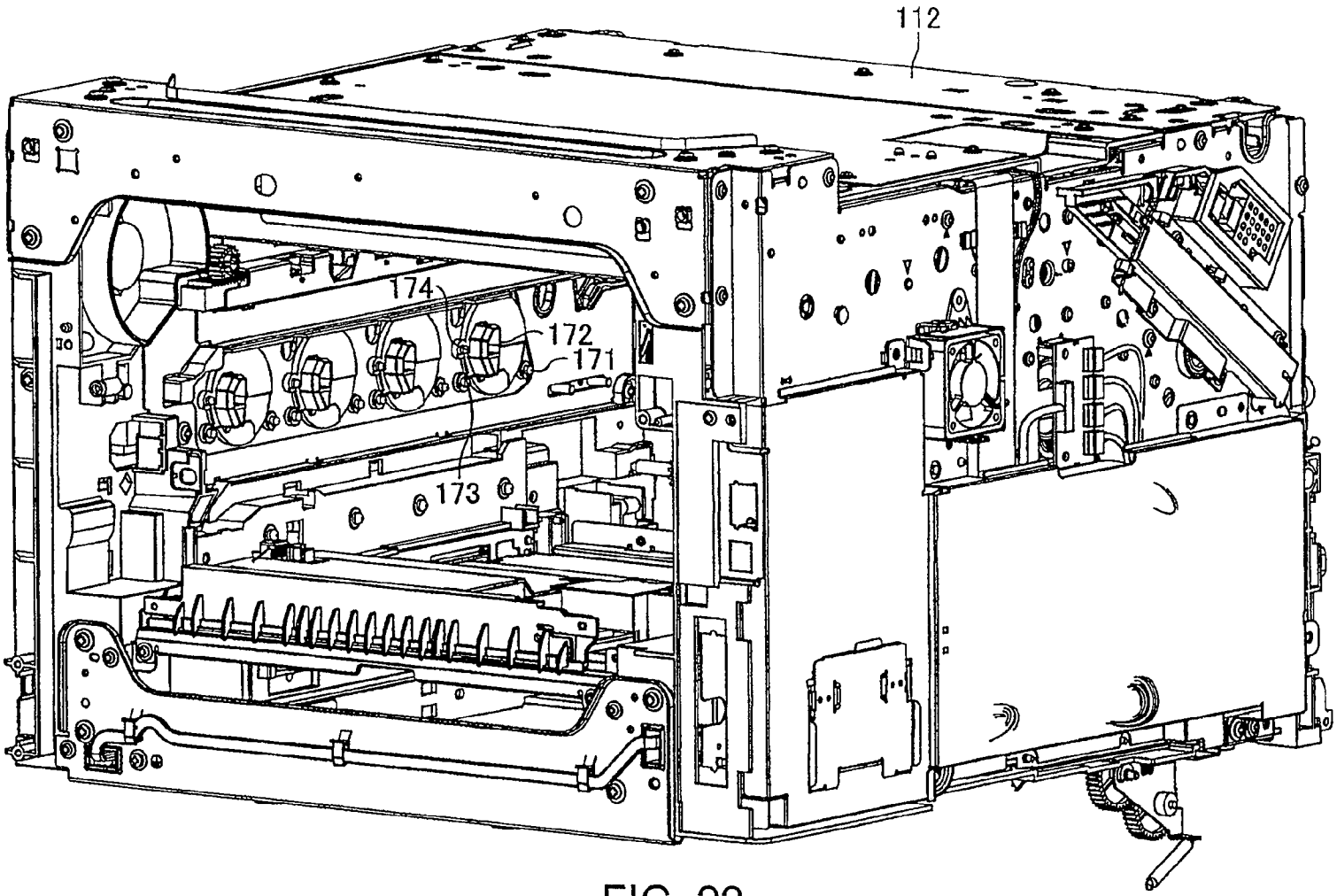
FIG. 22 is a perspective view of a body frame shown in FIG. 1 as viewed from the rear side.
Figure 23:
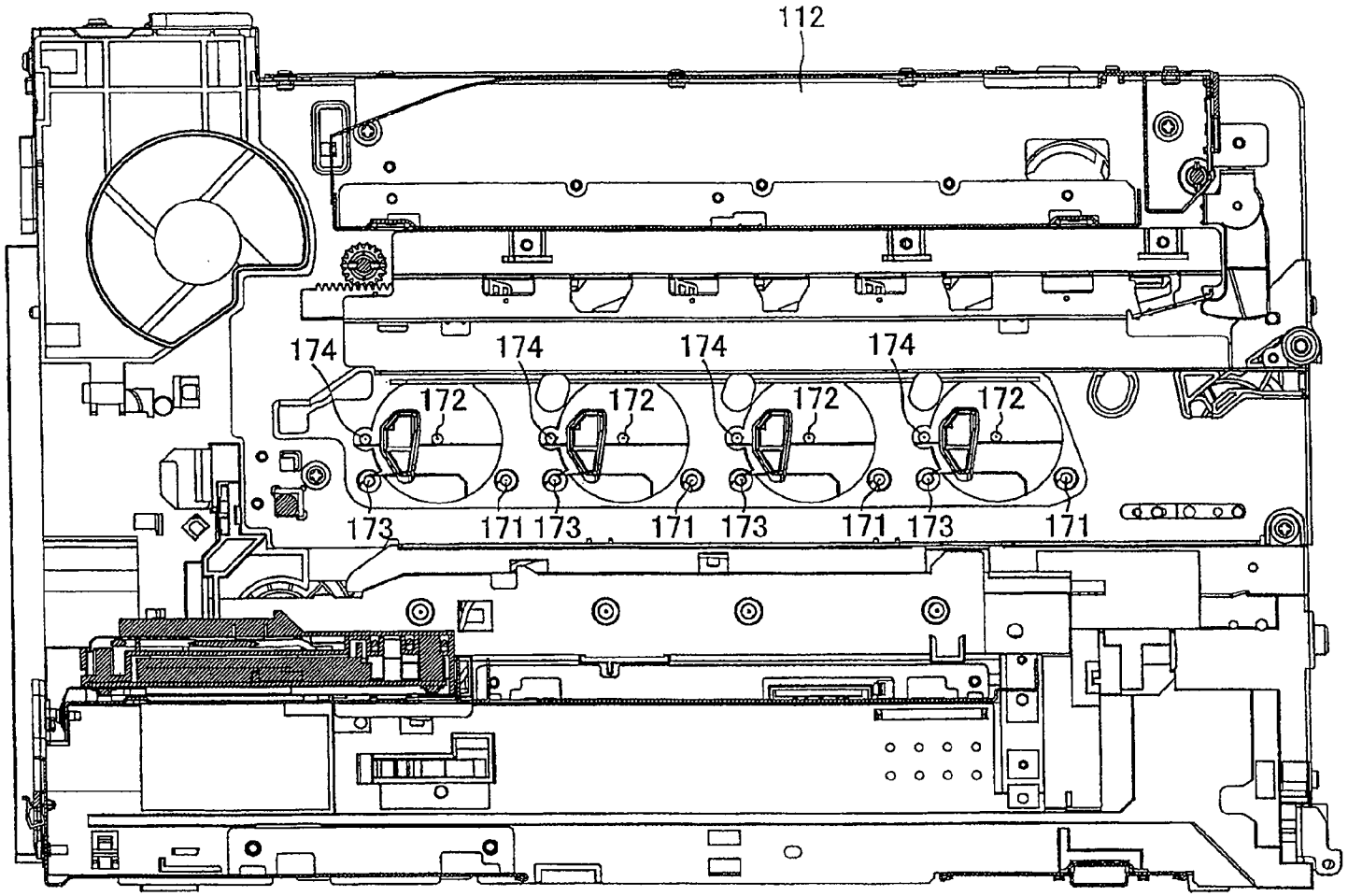
FIG. 23 is a side view seeing-through the interior of the body frame shown in FIG. 22.

FIG. 20 is a perspective view showing the outline of a configuration for feeding power to the color-image-forming unit 120 shown in FIG. 18. FIG. 21 is a perspective view showing, on an enlarged scale, a portion of FIG. 20. FIG. 22 is a perspective view of the body frame 112 shown in FIG. 1 as viewed from the rear side. FIG. 23 is a side view seeing-through the interior of the body frame 112 shown in FIG. 22.

Referring to FIGS. 20 and 21, each of developing-roller output terminals 171, which serve as the first body-frame contacts of the present invention, is disposed in such a manner as to face the first body-side contact 161*e*3 of the corresponding developing electrode member 161. Each of wire output terminals 172, which serve as the second body-frame contacts of the present invention, is disposed in such a manner as to face the corresponding wire power-feed electrode 162. Each of grid output terminals 173, which serve as the second body-frame contacts of the present invention, is disposed in such a manner as to face the corresponding grid power-feed electrode 163. Each of cleaner output terminals 174, which serve as the second body-frame contacts of the present invention, is disposed in such a manner as to face the corresponding cleaner power-feed electrode 164.

The developing-roller output terminals 171 are arranged along the slide direction S in corresponding relation with the arrangement of the first body-side contacts 161*e*3 (developing electrode members 161). Similarly, the wire output terminals 172, the grid output terminals 173, and the cleaner output terminals 174 are arranged along the slide direction S.

Each of the developing-roller output terminals 171 is urged in parallel with the paper width direction toward the corresponding first body-side contact 161*e*3 by an urging spring 175*a* and is electrically connected to an unillustrated high-voltage power source provided on the body frame 112 shown in FIGS. 22 and 23. As shown in FIG. 21, each of the developing-roller output terminals 171 is configured to be capable of elastically deforming the corresponding developing electrode member 161 along the direction indicated by the arrow M2 in the drawing by means of urging the first body-side contact 161*e*3 in the M2 direction.

Each of the wire output terminals 172 is urged in parallel with the paper width direction toward the corresponding wire power-feed electrode 162 by an urging spring 175*b* and is electrically connected to the unillustrated high-voltage power source provided on the body frame 112 shown in FIGS. 22 and 23. Urging springs 175*c* corresponding to the grid output terminals 173, and urging springs 175*d* corresponding to the cleaner output terminals 174 are also configured similarly.

Attachment/Detachment of Unit

Next will be described the attachment/detachment of the color-image-forming unit 120 in the color laser printer 100 of the present embodiment.

Referring to FIG. 1, by means of opening the front cover 111*e* frontward (toward the near side), the color-image-forming unit 120 is exposed to the outside through the front opening portion 111*d*. In this condition, when the slide frame 140 is drawn toward the near side along the slide direction S, as shown in FIG. 2, the color-image-forming unit 120 is drawn out toward the near side. This enables detachment of the image-forming cartridge(s) 130 which are exposed to the outside.

When the color-image-forming unit 120 is drawn out further toward the near side, as shown in FIG. 3, the color-image-forming unit 120 is completely drawn out to the exterior of the body section 110. This enables replacement of the color-image-forming unit 120.

Attachment/Detachment of Unit

Next will be described the attachment/detachment of the image-forming cartridge 130 to/from the color-image-forming unit 120 in the color laser printer 100 of the present embodiment.

Referring to FIGS. 14, 17, and 18, the image-forming cartridge 130 is inserted from above into a space between the first drum-unit side frame 155 and the second drum-unit side frame 156 in the drum unit 150.

In the initial stage of insertion of the image-forming cartridge 130 into the space, the coupling guide groove 155*a* guides the coupling support sleeve 136*b* and one end portion, with respect to the paper width direction, of the developing-roller-rotating shaft 134*a* along the cartridge attachment/detachment direction A. Also, the roller-energization-terminal-portion guide groove 156*a* guides the collar member 137 and the roller energization terminal portion 138*b* along the cartridge attachment/detachment direction A.

As mentioned above, in the initial stage of insertion of the image-forming cartridge 130 into the space, the image-forming cartridge 130 is guided along the cartridge attachment/detachment direction A.

In the last stage of insertion of the image-forming cartridge 130 into the space, the developing-roller guide groove 155*a*2 guides the one end portion of the developing-roller-rotating shaft 134*a* along the positioning direction A'. Also, the collar guide groove 156*b* guides the collar member 137 along the positioning direction A'. The one end portion of the developing-roller-rotating shaft 134*a* butts against a lower end portion of the developing-roller guide groove 155*a*2, and the collar member 137 butts against a lower end portion of the collar guide groove 156*b*, whereby positioning is established between the developing roller 134 and the photoconductor drum 151.

As mentioned above, in the last stage of insertion of the image-forming cartridge 130 into the space, while the collar member 137 and the one end portion of the developing-roller-rotating shaft 134*a* are guided along the positioning direction A', positioning is established between the developing roller 134 and the photoconductor drum 151. At this time, contact between the bend portion 161*b*1 and the roller energization terminal portion 138*b* establishes electrical connection between the developing roller 134 and the first body-side contact 161*e*3.

Meanwhile, the positioning direction A' is a direction along which the coupling portion 136*c* receives force when a rotational drive force is transmitted to the image-forming cartridge 130 from the body frame 112 (see FIG. 1) via the coupling portion 136*c*. That is, when a rotational drive force is transmitted to the image-forming cartridge 130, the image-forming cartridge 130 receives an obliquely downward directed force along the positioning direction A' via the coupling portion 136*c*. Accordingly, positioning between the developing roller 134 and the photoconductor drum 151 is stably carried out.

Electrical Communication Between Color-Image-Forming Unit and Body Frame

Next will be described electrical communication between the color-image-forming unit 120 and the body frame 112 in the color laser printer 100 of the present embodiment.

As shown in FIGS. 1 to 3, by means of the slide frame 140 being pushed into the body frame 112 along the slide direction S, the color-image-forming unit 120 is attached to the body frame 112.

At this time, referring to FIGS. 18 to 21, while being in contact with the developing-roller output terminal 171, each of the first body-side contacts 161*e*3 is urged by the corresponding urging spring 175*a* in the direction indicated by the arrow M2 in FIGS. 19 and 21. This causes the developing electrode member 161 to be elastically deformed along the M2 direction. This elastic deformation reliably establishes electrical connection between the first body-side contact 161*e*3 and the developing-roller output terminal 171.

Meanwhile, through contact with the corresponding wire output terminal 172 urged by the urging spring 175*b*, each of the wire power-feed electrodes 162 is electrically connected with the corresponding wire output terminal 172. Similarly, through contact with the corresponding rid output terminal 173 urged by the urging spring 175*c*, each of the grid power-feed electrodes 163 is electrically connected with the corresponding grid output terminal 173. Also, through contact with the corresponding cleaner output terminal 174 urged by the urging spring 175*d*, each of the cleaner power-feed electrode 164 is electrically connected with the corresponding cleaner output terminal 174.

Notably, the wire power-feed electrodes 162, the grid power-feed electrodes 163, and the cleaner power-feed electrodes 164 are not elastically deformed when pressed by the wire output terminals 172, the grid output terminals 173, and the cleaner output terminals 174, respectively.

Meanwhile, when the image-forming cartridge 130 runs out of toner, the image-forming cartridge 130 is replaced with a new one. Replacement of the image-forming cartridge 130 involves attachment/detachment of the image-forming cartridge 130 to/from the slide frame 140 (drum unit 150). Accordingly, the developing electrode members 161 undergo establishment and cancellation of electrical connection not only in attachment/detachment of the slide frame 140 to/from the body frame 112 along the slide direction S but also in attachment/detachment of the respective image-forming cartridges 130 to/from the slide frame 140 (respective drum units 150).

In contrast to the image-forming cartridge 130, the scorotron charger 152 and the drum cleaner 153 (see FIG. 12) are not subjected to replacement. Accordingly, the wire power-feed electrodes 162, the grid power-feed electrodes 163, and the cleaner power-feed electrodes 164 undergo establishment and cancellation of electrical connection only in attachment/detachment of the slide frame 140 to/from the body frame 112.

Accordingly, when maintenance work is repeated, the developing electrode members 161 are more susceptible to damage than are the wire power-feed electrodes 162, the grid power-feed electrodes 163, and the cleaner power-feed electrodes 164.

Furthermore, the developing-roller output terminals 171, the wire output terminals 172, the grid output terminals 173, and the cleaner output terminals 174 are provided on the body frame 112, and their replacement is not expected.

Thus, in the present embodiment, only the developing electrode members 161 are configured to be elastically deformable, whereas the wire power-feed electrodes 162, the grid power-feed electrodes 163, the cleaner power-feed electrodes 164, the developing-roller output terminals 171, the wire output terminals 172, the grid output terminals 173, and the cleaner output terminals 174 are configured to be elastically undeformable. The developing electrode members 161 are configured to be readily attachable to/detachable from the respective developing-electrode support portions 156*c*.

Thus, the configuration of the present embodiment can effectively restrain an increase in apparatus maintenance cost associated with occurrence of damage to electrical-connection zones.

Effect of Configuration of Embodiment

Next will be described the effect of the configuration of the color laser printer 100 according to an embodiment of the present invention, the effect of the configuration of the color-image-forming unit 120, and the effect of the configuration of the slide frame 140 (having the drum units 150) (hereinafter, these configurations are generically referred to as "the configuration of the present embodiment" or "the present embodiment").

In the configuration of the present embodiment, the first body-side contacts 161*e*3 of the developing electrode members 161 attached to the slide frame 140 and the respective developing-roller output terminals 171 attached to the body frame 112 are pressed against each other in a direction (direction indicated by the arrow M2 in FIG. 21) along the slide direction S. This establishes electrical connection between the first body-side contacts 161*e*3 and the respective developing-roller output terminals 171. At this time, the developing electrode members 161 provided on the slide frame 140 and having the first body-side contacts 161*e*3 are elastically deformed.

This configuration may suffer damage to the developing electrode member(s) 161, such as damage in which deformation of the developing electrode member 161 exceeds the limit of elastic deformation and reaches plastic deformation. However, in the configuration of the present embodiment, the developing electrode members 161 are provided on the slide frame 140, rather than on the body frame 112. This can effectively restrain occurrence of damage in electrical-connection zones on the side of the body frame 112, which involves greater difficulty in replacing members than does the slide frame 140.

The wire power-feed electrodes 162, the grid power-feed electrodes 163, and the cleaner power-feed electrodes 164, which are attached to the slide frame 140, are in contact with the wire output terminals 172, the grid output terminals 173, and the cleaner output terminals 174, respectively, which are attached to the body frame 112. This establishes electrical connection of the wire power-feed electrodes 162, the grid power-feed electrodes 163, and the cleaner power-feed electrodes 164 with the wire output terminals 172, the grid output terminals 173, and the cleaner output terminals 174, respectively.

At this time, the wire power-feed electrodes 162, the grid power-feed electrodes 163, and the cleaner power-feed electrodes 164 are pressed in the paper width direction orthogonal to the slide direction S. That is, a pressing direction for establishing electrical connection between the first body-side contacts 161*e*3 and the respective developing-roller output terminals 171 and a pressing direction for establishing electrical connection of the wire power-feed electrodes 162, the grid power-feed electrodes 163, and the cleaner power-feed electrodes 164 with the wire output terminals 172, the grid output terminals 173, and the cleaner output terminals 174, respectively, intersect with each other.

Thus, a pressing condition for establishing electrical connection between the first body-side contacts 161*e*3 and the respective developing-roller output terminals 171 and a pressing condition for establishing electrical connection of the wire power-feed electrodes 162, the grid power-feed electrodes 163, and the cleaner power-feed electrodes 164 with the wire output terminals 172, the grid output terminals 173, and the cleaner output terminals 174, respectively, can be established substantially independently of each other. This can effectively restrain the occurrence of, for example, the following drawback: when the pressing condition of the former is weakened for a certain reason, this causes weakening of the pressing condition of the latter, thereby unpreparedly canceling the electrically connected condition of the latter.

Thus, according to the present embodiment, an electrically connected condition can further be stabilized in electrical-connection zones between the body frame 110, and the image-forming unit 120 and a plurality of the image-forming cartridges 130.

In the present embodiment, the slide frame 140 is configured to be attachable to/detachable from the body frame 112. This facilitates replacement of the slide frame 140 or the developing electrode member(s) 161 even when the developing electrode member(s) 161 having the first body-side contact 161*e*3 is damaged, so that a good electrically connected condition can be readily restored.

According to the configuration of the present embodiment, when the image-forming cartridges 130 are attached to the slide frame 140, the bend portions 161*b*1 of the developing electrode members 161 and the respective roller energization terminal portions 138*b* are pressed against each other, whereby electrical connection is established between the developing electrode members 161 and the respective roller energization terminal portions 138*b*. Also, as mentioned above, when the slide frame 140 is attached to the body frame 112, the first body-side contacts 161*e*3 of the developing electrode members 161 and the respective developing-roller output terminals 171 are pressed against each other, whereby electrical connection is established between the first developing electrode members 161 and the respective developing-roller output terminals 171.

At this time, a direction along which the bend portions 161*b*1 and the respective roller energization terminal portions 138*b* are pressed against each other and a direction along which the first body-side contacts 161*e*3 and the respective developing-roller output terminals 171 are pressed against each other intersect with each other (cross at right angles). Thus, a pressing condition for establishing electrical connection between the bend portions 161*b*1 and the respective roller energization terminal portions 138*b* and a pressing condition for establishing electrical connection between the first body-side contacts 161*e*3 and the respective developing-roller output terminals 171 can be established substantially independently of each other.

Thus, an electrically connected condition can further be stabilized in electrical-connection zones between the body section 110, and the color-image-forming unit 120 and a plurality of the image-forming cartridges 130.

According to the configuration of the present embodiment, when each of the image-forming cartridges 130 carries out an image-forming operation, the coupling portion 136*c* of the image-forming cartridge 130 is urged along the positioning direction A'. Thus, positioning between the image-forming cartridge 130 and the slide frame 140 and electrical connection between the roller energization terminal portion 138*b* and the bend portion 161*b*1 can be established by means of a simple apparatus configuration.

According to the configuration of the present embodiment, the second drum-unit side frames 156 of the slide frame 140 have the respective roller-energization-terminal-portion guide grooves 156*a* for guiding the respective image-forming cartridges 130 along the cartridge attachment/detachment direction A. The bend portions 161*b*1 are disposed in such a manner as to face the respective roller-energization-terminal-portion guide grooves 156*a*.

According to this configuration, when each of the image-forming cartridges 130 is attached to the slide frame 140, the image-forming cartridge 130 is guided along the cartridge attachment/detachment direction A by the roller-energization-terminal-portion guide groove 156*a*. Also, upon completion of attachment of the image-forming cartridge 130 to the slide frame 140, the roller energization terminal portion 138*b* provided on the image-forming cartridge 130 comes into contact with the corresponding bend portion 161*b*1, which is disposed in such a manner as to face the corresponding roller-energization-terminal-portion guide groove 156*a*. This establishes electrical connection between the roller energization terminal portion 138*b* and the corresponding developing electrode member 161.

According to this configuration, while the image-forming cartridges 130 are guided by the respective roller-energization-terminal-portion guide grooves 156*a*, electrical connection is established between the bend portions 161*b*1, which are disposed in such a manner as to face the respective roller-energization-terminal-portion guide grooves 156*a*, and the respective roller energization terminal portions 138*b*. Therefore, the reliability of this electrical connection is improved.

In the present embodiment, the slide frame 140 has the first drum-unit side frames 155 and the second drum-unit side frames 156, which collectively serve as a pair of side plates, disposed in parallel with the slide direction S and with the cartridge attachment/detachment direction A. The roller-energization-terminal-portion guide grooves 156*a* are formed in the respective second drum-unit side frames 156.

According to this configuration, when each of the image-forming cartridges 130 is attached to the slide frame 140, the image-forming cartridge 130 is inserted into a space bounded by the corresponding first drum-unit side frame 155 and the corresponding second drum-unit side frame 156. At this time, the image-forming cartridge 130 is guided along the attachment/detachment direction A by the corresponding roller-energization-terminal-portion guide groove 156*a*.

According to this configuration, while the image-forming cartridges 130 are guided by the respective guide grooves 156*a*, electrical connection is established between the bend portions 161*b*1, which are disposed in such a manner as to face the respective roller-energization-terminal-portion guide grooves 156*a*, and the respective roller energization terminal portions 138*b*. Therefore, the reliability of this electrical connection can be improved by means of a simple apparatus configuration.

In the present embodiment, each of the developing electrode members 161 is formed integrally from a single spring steel wire. That is, the developing electrode member 161 has the first coil spring portion 161*a*, which serves as the wirelike connection portion, for connecting the body-side terminal 161*c* (first body-side contact 161*e*3) and the cartridge-side terminal 161*b* (bend portion 161*b*1). The developing electrode member 161 is attached in the vicinity of the corresponding roller-energization-terminal-portion guide groove 156*a*. Also, an arm portion extending outward from the first coil spring portion 161*a* is used to form the cartridge-side terminal 161*b* (bend portion 161*b*1).

According to this configuration, each of the electrode members for establishing electrical connection between the body section 110 and the image-forming cartridges 130 can be formed in a very simple structure. Also, the electrode members are disposed in the vicinity of the respective roller-energization-terminal-portion guide grooves 156*a*. Thus, electrical connection is more reliably established between the developing electrode member 161 having the bend portions 161*b*1, which are disposed in such a manner as to face the respective roller-energization-terminal-portion guide grooves 156*a*, and the respective roller energization terminal portions 138*b*.

In the present embodiment, each of the roller energization terminal portions 138*b* assumes the form of an electrically conductive projection formed to be capable of being received in the corresponding roller-energization-terminal-portion guide groove 156*a*. The roller energization terminal portion 138*b* is disposed to be capable of being electrically connected with the corresponding cartridge-side terminal 161*b* (bend portion 161*b*1) through contact with the cartridge-side terminal 161*b* (bend portion 161*b*1).

According to this configuration, when each of the image-forming cartridges 130 is attached to the slide frame 140, the roller energization terminal portion 138*b* is received in the corresponding roller-energization-terminal-portion guide groove 156*a*. By virtue of this, the image-forming cartridge 130 is guided by the roller-energization-terminal-portion guide groove 156*a*. Also, through contact of the roller energization terminal portion 138*b* with the corresponding bend portion 161*b*1, electrical connection is established between the roller energization terminal portion 138*b* and the corresponding cartridge-side terminal 161*b*.

According to this configuration, by means of a very simple apparatus configuration, the image-forming cartridges 130 can be smoothly attached to the slide frame 140. Also, by means of a very simple apparatus configuration, a reliable, electrically connected condition can be established between the roller energization terminal portions 138*b* and the respective cartridge-side terminals 161*b*.

According to the configuration of the present embodiment, a plurality of the first drum-unit side frames 155 and a plurality of the second drum-unit side frames 156 are arranged a long the slide direction S in corresponding relation with the image-forming cartridges 130. The first side plate 142 and the second side plate 144, which each serve as a side plate, are disposed externally of and support the first drum-unit side frames 155 and the second drum-unit side frames 156, respectively. The first body-side contacts 161*e*3, the wire power-feed electrodes 162, the grid power-feed electrodes 163, and the cleaner power-feed electrodes 164 are disposed in such a manner as to extend through the second side plate 144 and to be exposed to the outside of the second side plate 144.

According to this configuration, a configuration for supporting the image-forming cartridges 130 arranged along the slide direction S and a configuration for establishing electrical communication of the body section 110 with the developing rollers 134, the scorotron chargers 152, and the drum cleaners 153, which are provided on the slide frame 140, can be formed inexpensively by a very simple manufacturing process.

In the configuration of the present embodiment, drive force is transmitted from the body frame 112 to each of the image-forming cartridges 130 at one end portion, with respect to the paper width direction, of the image-forming cartridge 130. By contrast, electrical connection between the body section 110 and members on the slide frame 140 is established at the other end portion, with respect to the paper width direction, of the image-forming cartridge 130 via the developing electrode member 161, the wire power-feed electrode 162, the grid power-feed electrode 163, and the cleaner power-feed electrode 164.

According to this configuration, even when foreign matter, such as dust or oil stain, arises in a zone of transmission of drive force, there can be reliably prevented adhesion of the foreign matter to zones of electrical connection of the developing electrode members 161 with the respective roller energization terminal portions 138*b* or the respective developing-roller output terminals 171 and zones of electrical connection of the wire power-feed electrodes 162, the grid power-feed electrodes 163, and the cleaner power-feed electrodes 164 with the wire output terminals 172, the grid output terminals 173, and the cleaner output terminals 174, respectively. Therefore, a reliable, electrically connected condition can be established in the electrical-connection zones.

In the present embodiment, the number of the developing electrode members 161 corresponds to the number of the image-forming cartridges 130.

According to this configuration, each of the developing electrode members 161 for establishing electrical connection between the body section 110 and a plurality of the image-forming cartridges 130 can be formed in a very simple structure.

Modifications

The above-described embodiment is a mere example of the best mode which the applicant of the present invention contemplated at the time of filing the present application. The present invention is not limited to the above-described embodiment. Various modifications to the above-described embodiment are possible so long as the invention is not modified in essence.

Typical modifications will next be exemplified. In the following description of the modifications, members similar in structure and function to those used in the above-described embodiment can be denoted by the same reference numerals as those of the above-described embodiment. As for the description of these members, an associated description appearing in the description of the above-described embodiment can be cited so long as no technical inconsistencies are involved.

Needless to say, modifications are not limited to those exemplified below. Also, a plurality of modifications can be combined as appropriate so long as no technical inconsistencies are involved.

The above-described embodiment and the following modifications should not be construed as limiting the present invention (particularly, those components which partially compose means for solving the problems to be solved by the invention and are illustrated with respect to operations and functions). Such limiting construal unfairly impairs the interests of an applicant (who is in hurry to file under the first-to-file system), unfairly benefits imitators, is adverse to the purpose of the Patent Law of protecting and utilizing an invention, and is thus impermissible.

(1) An image-forming apparatus to which the present invention is applied is not limited to a color laser printer. For example, the present invention can be applied to a color copier.

(2) The slide frame 140 and the drum units 150 may be integrally formed. Specifically, the configuration may be such that the first side plate 142 and the first drum-unit side frames 155 are integrally formed with no seam formed therebetween and such that the second side plate 144 and the second drum-unit side frames 156 are integrally formed with no seam formed therebetween.

(3) At least one of the photoconductor drum 151, the scorotron charger 152, and the drum cleaner 153 may be provided on each of the image-forming cartridges 130.

(4) The collar member 137 may be formed from an electrically conductive synthetic resin. In this case, each of the developing electrode members 161 may be configured and disposed to be electrically connected with the corresponding collar member 137 through contact with the collar member 137.

According to this configuration, when each of the image-forming cartridges 130 is attached to the slide frame 140, by means of the collar member 137 being received in the corresponding roller-energization-terminal-portion guide groove 156*a*, the image-forming cartridge 130 is guided by the roller-energization-terminal-portion guide groove 156*a*. Electrical connection is established between the developing electrode member 161 and the collar member 137 (developing roller 134) through contact of the collar member 137 with the corresponding bend portion 161*b*1.

According to this configuration, by means of a very simple apparatus configuration, a reliable, electrically connected condition can be established between the developing roller 134 and the corresponding developing electrode member 161 (bend portion 161*b*1).

(5) In the above-described embodiment, the positioning direction A' and the pressing direction M1 between the bend portion 161*b*1 and the roller energization terminal portion 138*b* are substantially in parallel with a plane perpendicular to the paper width direction and are substantially perpendicular to each other. However, the positioning direction A' and the pressing direction M1 between the bend portion 161*b*1 and the roller energization terminal portion 138*b* may be substantially in parallel with each other.

According to this configuration, by means of each of the image-forming cartridges 130 being urged in the positioning direction A', positioning is established between the image-forming cartridge 130 and the slide frame 140. At this time, the roller energization terminal portion 138*b* provided on the image-forming cartridge 130 and the corresponding bend portion 161*b*1 provided on the slide frame 140 are pressed against each other in a direction substantially in parallel with the positioning direction A'.

Notably, the positioning direction A' and the pressing direction M1 may face the same direction or opposite directions. Particularly, in the former case, by means of the pressing direction M1 and the positioning direction A' coinciding with each other, positioning is carried out more reliably.

(6) A method or structure for urging each of the image-forming cartridges 130 for positioning of the image-forming cartridge 130 is not limited to that in which drive force is transmitted to the coupling portion 136*c* as in the case of the above-described embodiment. Various other forms may be employed.

For example, the body section 110 may have a structure for pressing each of the image-forming cartridges 130. Alternatively, each of the image-forming cartridges 130 may have a structure for urging itself downward.

Figure 24B:
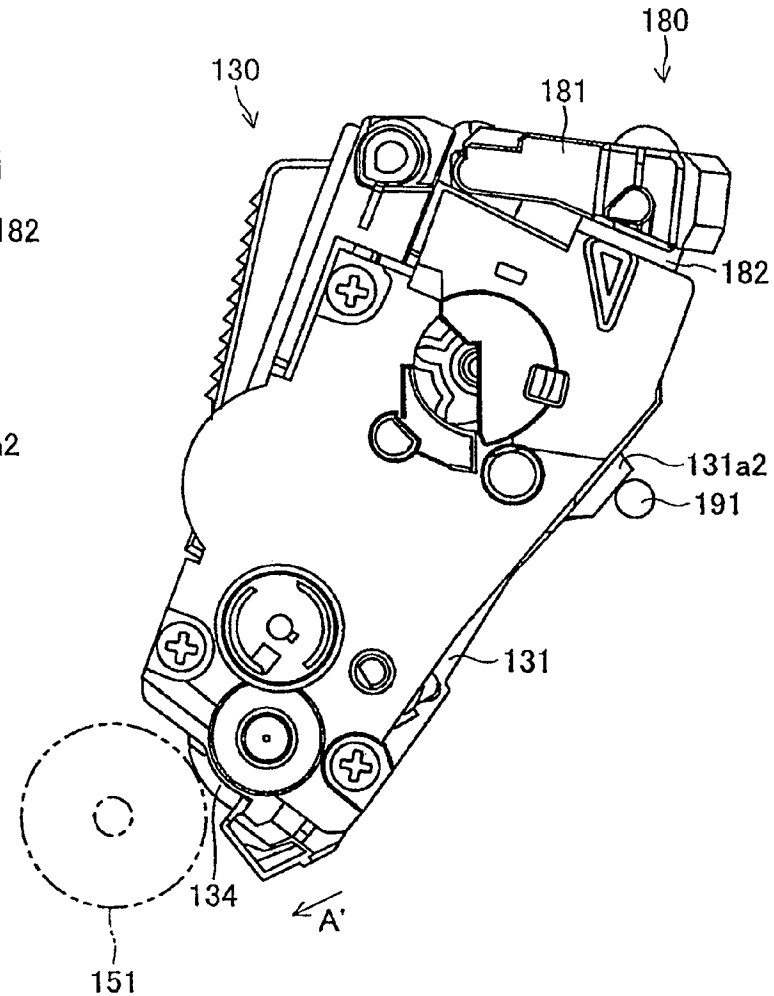
FIG. 24B shows a pressed condition.
Figure 24A:
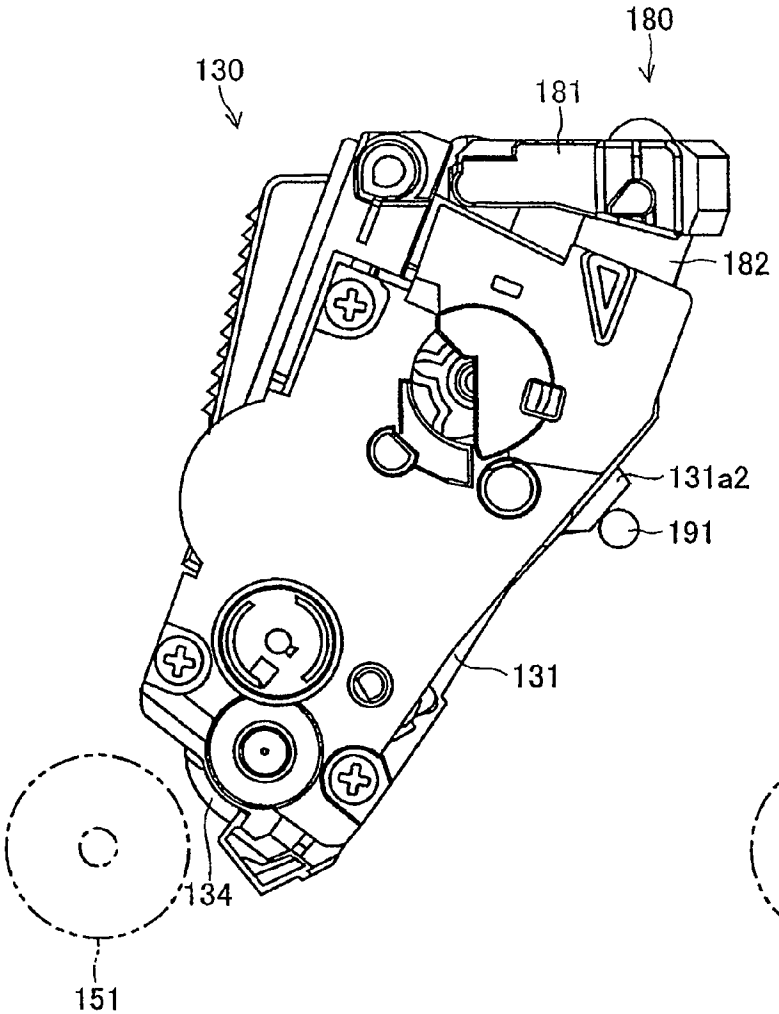
FIG. 24A shows an unpressed condition (refracted condition)

FIG. 24 is a pair of side views showing an exemplary structure for urging downward the image-forming cartridge 130 shown in FIG. 5, wherein FIG. 24A shows an unpressed condition (refracted condition), and FIG. 248 shows a pressed condition.

Referring to FIG. 24, a pressing-operation mechanism 180 is provided at an upper end portion (opposite a side at which the developing roller 134 is attached) of the cartridge case 131 of the image-forming cartridge 130. The pressing-operation mechanism 180 has a handle 181 and an urging-force-generating portion 182.

The handle 181 is pivotably supported at the rear side (far side in FIGS. 1 to 3) of the upper end portion of the cartridge case 131. The urging-force-generating portion 182 is provided at the front side (near side in FIGS. 1 to 3) of the upper end portion of the cartridge case 131 in such a manner as to face a free end portion of the handle 181. The urging-force-generating portion 182 is configured as described below, so as to be capable of urging downward the cartridge case 131 when the free end portion of the handle 181 is moved downward as shown in FIG. 248.

Figure 25B:
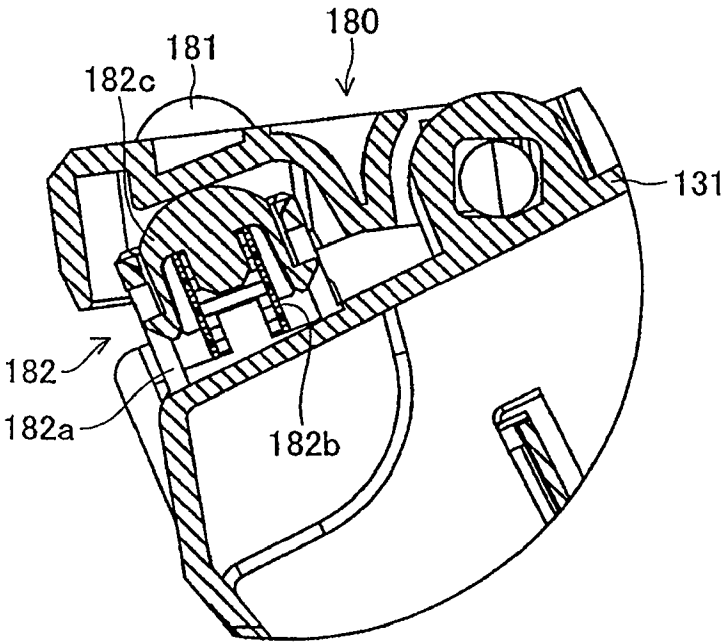
FIG. 25B shows a pressed condition.
Figure 25A:
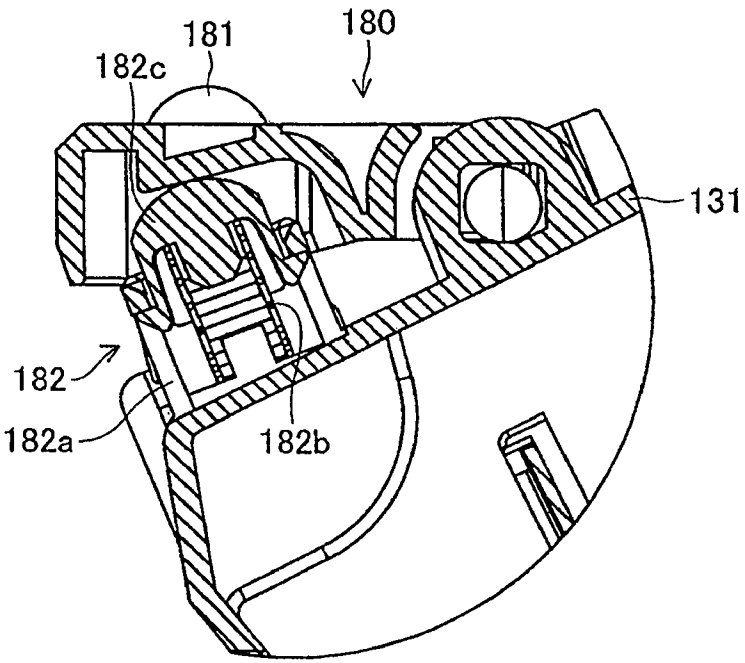
FIG. 25A shows an unpressed condition.

FIG. 25 is a pair of side sectional view showing, on an enlarged scale, the pressing-operation mechanism 180 shown in FIG. 24, wherein FIG. 25A shows an unpressed condition, and FIG. 258 shows a pressed condition.

Referring to FIG. 25, the urging-force-generating portion 182 has a support sleeve 182*a*, a developing-cartridge-urging spring 182*b*, and an actuator 182*c*.

The support sleeve 182*a* is a tubular member which is provided in such a manner as to project substantially upward from the upper end portion of the cartridge case 131, and is formed integrally with the cartridge case 131. An internal space of the support sleeve 182*a* accommodates the developing-cartridge-urging spring 182*b*, which is a coil spring. The actuator 182*c* is attached to an upper end of the developing-cartridge-urging spring 182*b*. The actuator 182*c* is configured such that, by means of the free end portion of the handle 181 pressing the actuator 182*c*, the actuator 182*c* can move downward while being guided by the support sleeve 182*a*.

Referring to FIGS. 24 and 25, the pressing-operation mechanism 180 is configured to be capable of converting a downward movement of the free end portion of the handle 181 to a force of urging the image-forming cartridge 130 obliquely downward. A mechanism for moving downward the free end portion of the handle 181 is provided on the body frame 112 (see FIGS. 22 and 23).

Referring to FIG. 24, a guide member 191 is provided in such a manner as to face the foot portion 131*a*2 of the cartridge case 131. The guide member 191 is a roller which is pivotably supported by the drum unit 150 (see FIG. 17).

According to this configuration, the mechanism provided on the body frame 112 (see FIGS. 22 and 23) moves downward the free end portion of the handle 181. This causes the free end portion of the handle 181 to press the actuator 182*c* downward. This causes the developing-cartridge-urging spring 182*b* to be compressed and deformed. An elastic force associated with the developing-cartridge-urging spring 182*b* attempting to recover from the compressional deformation by means of spring elasticity urges the image-forming-cartridge 130 (cartridge case 131) downward along the positioning direction A'.

Notably, the guide member 191 may be a plane instead of a roller.

(7) Although they are not mentioned specifically, variations other than those mentioned above are possible without departing from the spirit of the present invention.

Those components which partially compose means for solving the problems to be solved by the invention and are illustrated with respect to operations and functions encompass not only the specific structures disclosed above in the description of the above embodiment and modifications but also any other structures that can implement the operations and functions.

What is claimed is:

1. An image-forming apparatus, comprising:

a main body frame:

a slide frame which is supported by the body frame such that the slide frame can be drawn out from the body frame along a predetermined slide direction;

a plurality of image-forming cartridges configured to be arranged along the slide direction and configured to be attached to the slide frame in such a manner as to be removable along a predetermined attachment/detachment direction intersecting with the slide direction, each of the plurality of image-forming cartridges which has a developing roller disposed in such a manner as to face an electrostatic-latent-image-carrying body and an image-forming-cartridge contact; and a plurality of electrodes mounted on the slide frame in such a manner that each of the electrodes which corresponds to each of the image-forming cartridges in one-to-one fashion; wherein each of the electrodes includes a cartridge-side electrode configured to establish electrical connection to the developing roller by contacting the image-forming-cartridge contact; and each of the cartridge-side electrodes comprises:

a coil portion having a shape of a coil spring, a latch portion provided at one end of the coil portion and configured to be supported by the slide frame, an arm portion provided at the other end of the coil portion and having a cartridge-side contact configured to contact the image-forming-cartridge contact.

2. An image-forming apparatus according to claim 1, wherein each of the electrodes is formed by an Integral wire member.

3. An image-forming apparatus according to claim 2, wherein each of the electrodes further includes a body-side electrode having a body-side contact (161*e*3) configured to establish electrical connection to a body-frame contact provided at the body frame, wherein the body-side electrode is connected to the cartridge-side electrode in order to establish electrical connection to each other.

4. An image-forming apparatus according to claim 3, wherein the slide frame is configured to be attachable to and detachable from the body frame.

5. An image-forming apparatus according to claim 4, wherein the slide frame has guide portion for guiding the respective image-forming cartridges along the attachment/detachment direction, and the cartridge-side contact is disposed in such a manner as to face the respective guide portion.

6. An image-forming apparatus according to claim 5, wherein the slide frame has a pair of side plates disposed in parallel with the slide direction and with the attachment/detachment direction, and the guide portion comprises a guide groove formed on the side plate.

7. An image-forming apparatus according to claim 6, wherein each of the image-forming-cartridge contacts is formed by an electrically conductive projection formed to be capable of being received in the guide groove, and each of the cartridge-side contacts is disposed to be capable of being electrically connected with the corresponding projection through contact with the projection.

8. An image-forming apparatus according to claim 7, wherein each of the projections comprises a collar member made of an electrically conductive, synthetic resin and configured to cover a metal shaft projecting from a longitudinal end portion of the corresponding developing roller.

9. An image-forming apparatus according to claim 8, wherein each of the image-forming cartridges is configured such that drive force is transmitted from the body frame to the image-forming cartridge at one end portion, with respect to a width direction orthogonal to the slide direction and to the attachment/detachment direction, of the image-forming cartridge, and each of the electrodes is disposed in such a manner as to face the other end portion, different from the one end portion, of the corresponding image-forming cartridge.

10. An image-forming apparatus according to claim 9, wherein a plurality of electrostatic-latent-image-carrying bodies are arranged along and mounted on the slide frame in corresponding relation with the image-forming cartridges.

11. An image-forming apparatus according to claim 10, wherein each electrostatic-latent-image-carrying body comprising a cylindrical member disposed along the width direction orthogonal to the slide direction and to the attachment/detachment direction and rotatably supported by the slide frame; and when each of the image-forming cartridges is attached to the slide frame, the image-forming cartridge is disposed to face the electrostatic-latent-image-carrying body, so as to be capable of developing the electrostatic latent image formed on the circumferential surface of the electrostatic-latent-image-carrying body.

12. An image-forming apparatus according to claim 1, wherein each of the image-forming cartridges is configured such that drive force is transmitted from the body frame to the image-forming cartridge at one end portion, with respect to a width direction orthogonal to the slide direction and to the attachment/detachment direction, of the image-forming cartridge, and each of the electrodes is disposed in such a manner as to face the other end portion, different from the one end portion, of the corresponding image-forming cartridge.

13. An image-forming apparatus according to claim 12, wherein the slide frame has guide portion for guiding the respective image-forming cartridges along the attachment/detachment direction, and the cartridge-side contact is arranged in a projection plane of the guide portion in the slide direction.

* * * * *

UNITED STATES PATENT AND TRADEMARK OFFICE

CERTIFICATE OF CORRECTION

PATENT NO. : 8,265,513 B2
APPLICATION NO. : 13/344323
DATED : September 11, 2012
INVENTOR(S) : Yasushi Okabe It is certified that error appears in the above-identified patent and that said Letters Patent is hereby corrected as shown below:

In the Claims

Column 36, Claim 2, Line 13:
Please delete "Integral" and insert --integral--

Column 36, Claim 3, Line 17:
Please delete "contact **(161*e*3)** configured" and insert --contact configured--

Signed and Sealed this
Eighteenth Day of June, 2013

Teresa Stanek Rea
*Acting Director of the United States Patent and Trademark Office*